US005582467A

United States Patent [19]

Drolet et al.

[11] Patent Number: 5,582,467

[45] Date of Patent: Dec. 10, 1996

[54] DISPLACEABLE WORKING APPARATUS WITH EXTENSIBLE BOOM

[75] Inventors: Luc Drolet, Sillery; Gaetan Sanschagrin, Chrysostome; Michel Garand, Québec, all of Canada

[73] Assignee: Centre de Recherche Industrielle du Québec, Quebec, Canada

[21] Appl. No.: 419,118

[22] Filed: Apr. 10, 1995

[51] Int. Cl.[6] ..... B66F 11/04; F21C 11/00

[52] U.S. Cl. ..... 299/33; 182/37; 299/70; 405/146

[58] Field of Search ..... 299/30, 33, 70, 299/73, 75; 405/146, 157; 182/36, 37, 141, 142

[56] References Cited

U.S. PATENT DOCUMENTS

| | | | |
|---|---|---|---|
| 1,429,012 | 9/1922 | Andrews | 182/36 X |
| 2,846,081 | 8/1958 | Moore | 212/317 |
| 3,141,521 | 7/1964 | Read et al. | 182/36 X |
| 3,446,292 | 5/1969 | Stauffer | 299/70 X |
| 3,828,862 | 8/1974 | Dabell et al. | 299/70 X |
| 4,098,371 | 7/1978 | Cox | 182/2 |
| 4,239,291 | 12/1980 | Skendrovic | 299/70 |
| 4,260,297 | 4/1981 | Houston et al. | 405/146 X |
| 4,960,175 | 10/1990 | Granskog | 175/86 |
| 5,007,683 | 4/1991 | Granskog | 299/10 |
| 5,113,969 | 5/1992 | Drolet et al. | 182/82 X |

FOREIGN PATENT DOCUMENTS

| | | | |
|---|---|---|---|
| 1183556 | 3/1985 | Canada . | |
| 2478190 | 9/1981 | France . | |
| 1461977 | 2/1989 | U.S.S.R. | 405/290 |

*Primary Examiner*—David J. Bagnell

[57] ABSTRACT

A displaceable working apparatus provided with a platform having an extensible boom and being displaced on a guide rail is disclosed. The apparatus has a main frame secured to a main support which is movably secured to the guide rail and a main stabilizing mechanism for immovably securing the main frame to the adjacent roof surface. An extensible boom having a working free end which is equipped with a working element and is pivotally secured to a rotating support base positioned under the main frame. The boom is rotatable on the rotating support base and is angularly positionable with respect to the rotating support base. A drive is mounted on the frame to displace the platform along the guide rail.

56 Claims, 15 Drawing Sheets

DISPLACEABLE WORKING APPARATUS WITH EXTENSIBLE BOOM

BACKGROUND OF INVENTION

1. Field of Invention

The present invention relates to a displaceable working apparatus provided with a platform having an extensible boom and being displaced on a guide rail, and more particularly to a mine working apparatus which is displaced in a mine cavity along a guide rail from an initial position, such as a storage place, to a desired working position along the guide rail, where a working element secured to a working free end of the extensible boom can be displaced into a working area.

2. Description of Prior Art

Many rail mounted working apparatuses have been proposed for displacing working element, such as a platform or a tool, into a working area. Such apparatuses are, for example, described in Moore U.S. Pat. No. 2,846,081, Cox U.S. Pat. No. 4,098,371, Granskog U.S. Pat. Nos. 5,007,863 and 4,960,175, and finally CA 1,183,556 and FR 2,478,190 to Svensson. Moore teaches a boom loader for overhead crane having a horizontally extending rail disposed over a carriage suspended therefrom, a circle track below the carriage and trolley trucks mounted on the tracks for rotational movement in a horizontal plane of a boom secured to the trolley trucks. Cox teaches a mobile scaffold having a carriage for traversing longitudinally a pair of horizontally extending rails disposed in a vertical spaced parallel relationship, which carriage is provided with a pivot assembly rotating in a horizontal plane on which is mounted a parallel arm type boom swinging in a vertical plane pivoting and having an operators platform secured to a free end thereto. In U.S. Pat. No. 4,960,175, Granskog proposes a mine working assembly for raise mining including a drive support displaceable along a guide rail and carrying a drill boom rig and an operators and service platform. A similar type of equipment is taught by Svensson in CA 1,183,556. In U.S. Pat. No. 5,007,683, Granskog further proposes a mine working equipment having a lift cage suspended from a transport guide rail and supporting a drill boom. In FR 2,478,190, Svensson further teaches a rail mounted raise drilling equipement comprising an operators platform and a hoisting device displacing a drill boom. Such prior art apparatuses do not provide full movement of the working element within the working area as required in many applications, such as in mine working. In U.S. Pat. No. 5,113,969 issued to the applicant, a displaceable working platform provided with an extensible boom is described, which boom is secured to a rotating support base mounted on a displaceable platform provided on a main frame, which has stabilizing extension posts secured thereto fir immovably securing the main frame to surrounding surfaces. Such working platform can support a mine worker or a mine working tool over long distances in mine shafts, drifts or along excavated veins disposed transversely to mine galleys. However, while such displaceable working platform is an improvement over other prior art apparatuses, it cannot be used in a mine cavity not capable of supporting a floor standing platform, such as in a deep mining chamber. Furthermore, although the working element provided on such a platform can be easily and quickly retracted from the excavating tunnel without having to displace the main support frame each time the working element is retracted and repositioned, the main support frame still has to be initially displaced from an initial position, such as a storage place, to a desired working position in proximity of the working area.

Therefore, there is still a need to provide a working apparatus that can be easily and quickly installed in a working position and which provides full movement of a working element in a working area.

SUMMARY OF INVENTION

It is a feature of the present invention to provide a working apparatus, and particularly, a mine working apparatus that can be displaced from an initial position to a working position in proximity of a working area, which can be immovably secured to an adjacent surface and which is provided with a telescopic boom to a rotating support base position under a main frame, and wherein the boom can be pivoted and extended along axes positioned at various angles within a mine cavity such as gallery, shaft or chamber.

According to the above features, from a broad aspect, the present invention provides a displaceable working apparatus comprising a guide rail comprised of a plurality of connected guide rail sections suspended from a surface adjacent thereto. A displaceable working platform comprised of a main frame secured to a main support means movably secured to the rail is also provided. The apparatus further comprises main stabilizing means for immovably securing the main frame to the adjacent surface, and an extensible boom pivotally secured to a rotating support base positioned under the main frame and secured thereto. The boom has a working free end provided with a working element secured thereto. Means is provided to rotate the boom on the rotating support base. Means is further provided to control the extension of the boom. Still further, a means is provided to regulate the angular position of the boom with respect to the rotating support base. The apparatus further comprises a driving means mounted on the frame to displace the platform along the guide rail.

BRIEF DESCRIPTION OF DRAWINGS

Preferred embodiments of the present invention will now be described with reference to the accompanying drawings in which:

FIG. 6 is a front view of the working apparatus of FIG. 1 shown in a transport mode, illustrating displacement of the apparatus along a curved rail portion.

DESCRIPTION OF PREFERRED EMBODIMENTS

Figure 1:
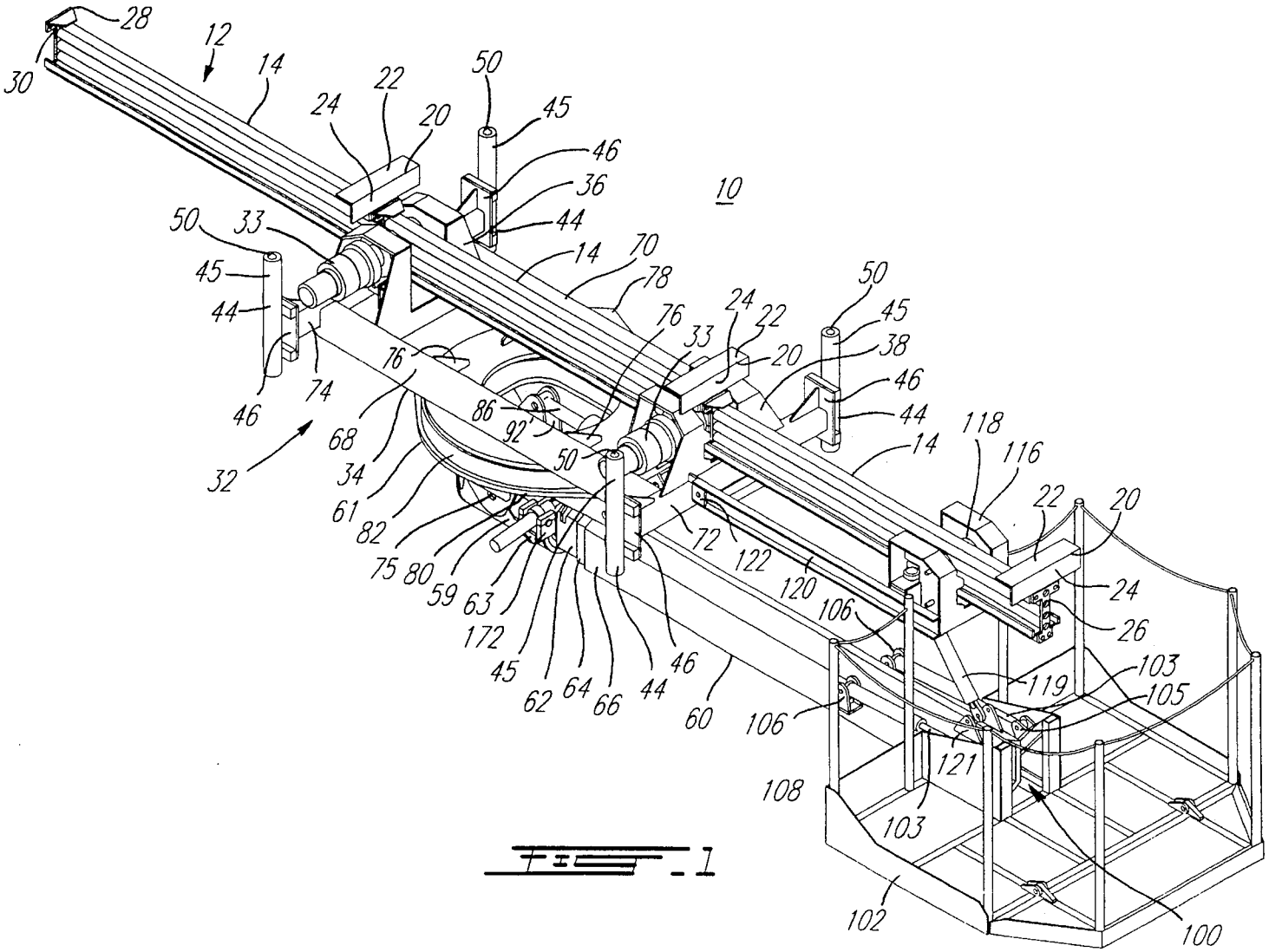
FIG. 1 is a perspective view of a displaceable working apparatus according to a first preferred embodiment of the present invention shown at a storage position or in a transport mode, wherein the platform has its extensible boom being retracted and having its free end being attached to a guide rail extending above the platform.
Figure 2A:
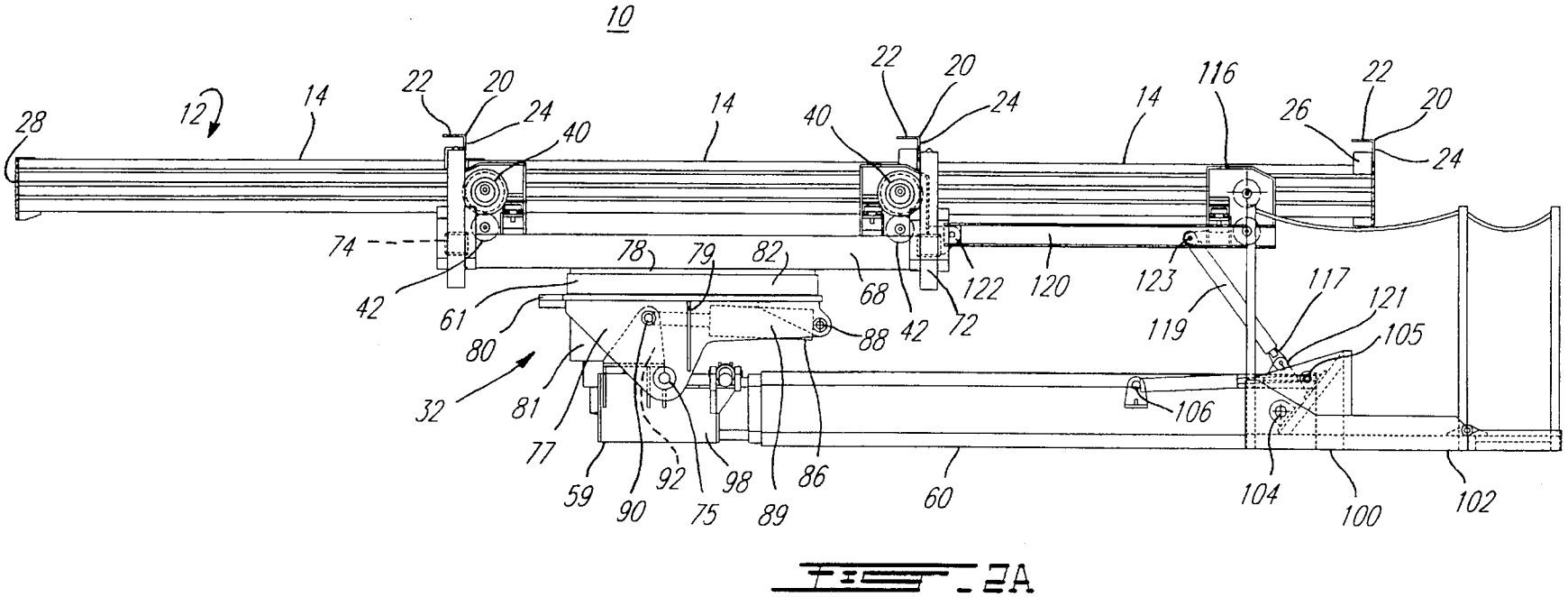
FIG. 2A, 2B and 2C are respectively front, top and end views of the working apparatus as shown in FIG. 1.
Figure 2B:
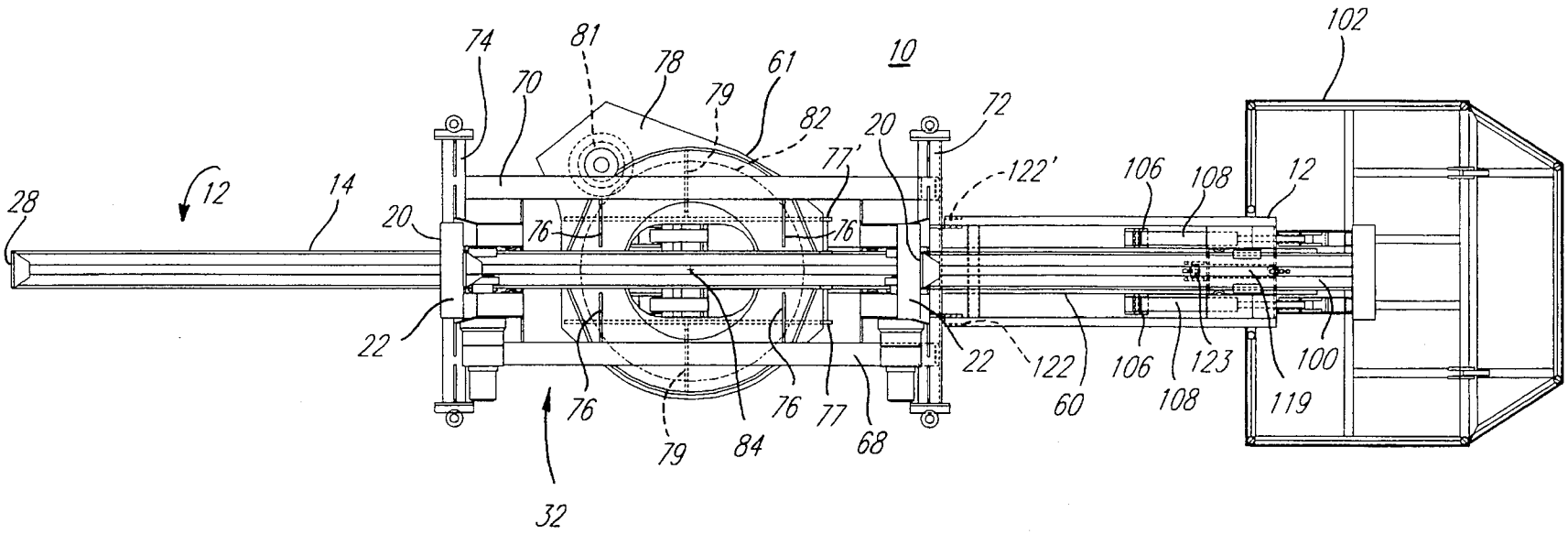
Figure 2C:
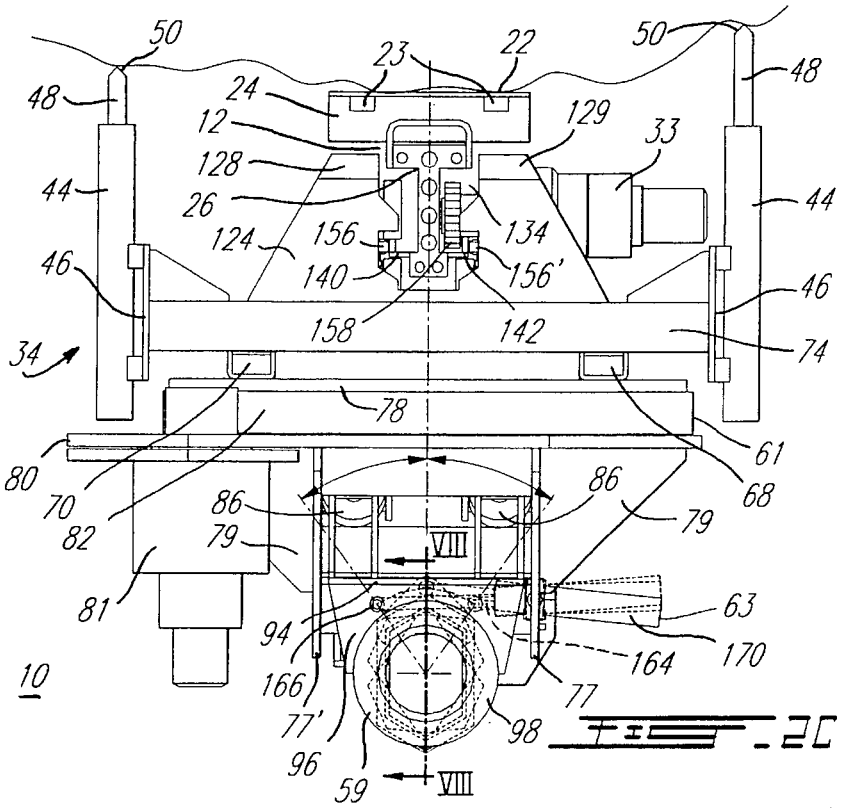
Figure 3:
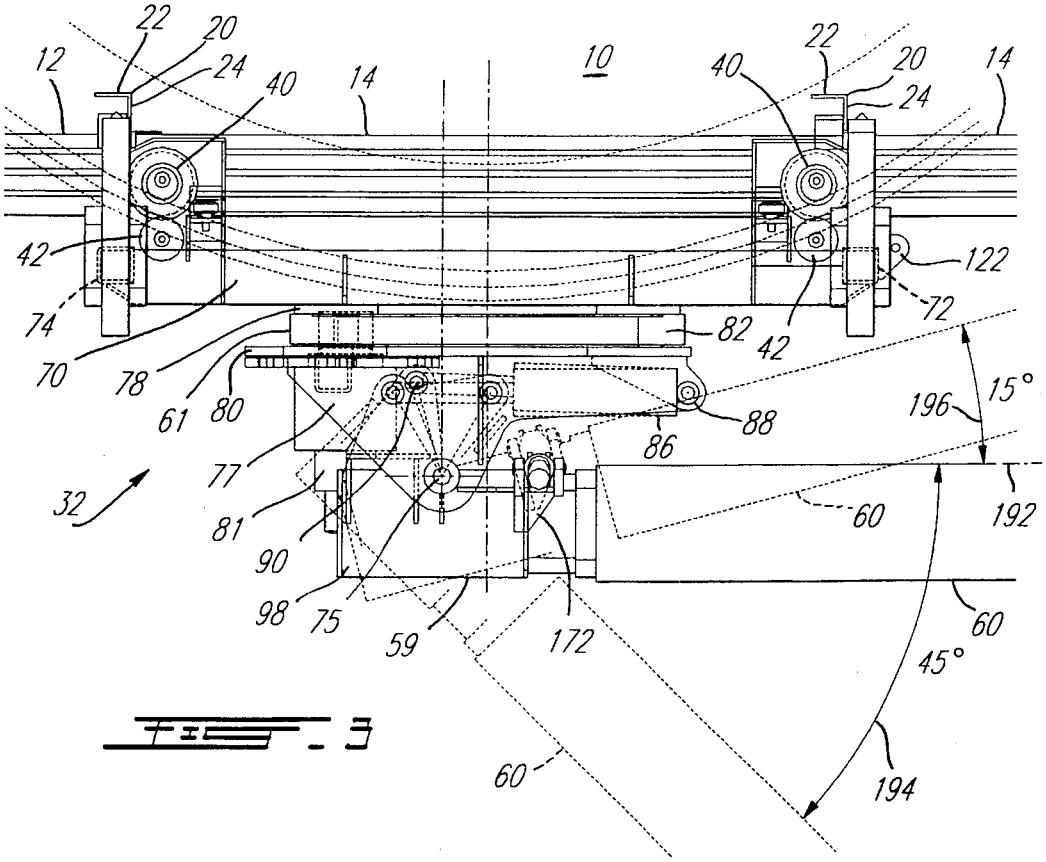
FIG. 3 is a partial front view of the working apparatus of FIG. 1 showing up and down angular positioning of the boom transversely under structural members provided on the platform frame.
Figure 4:
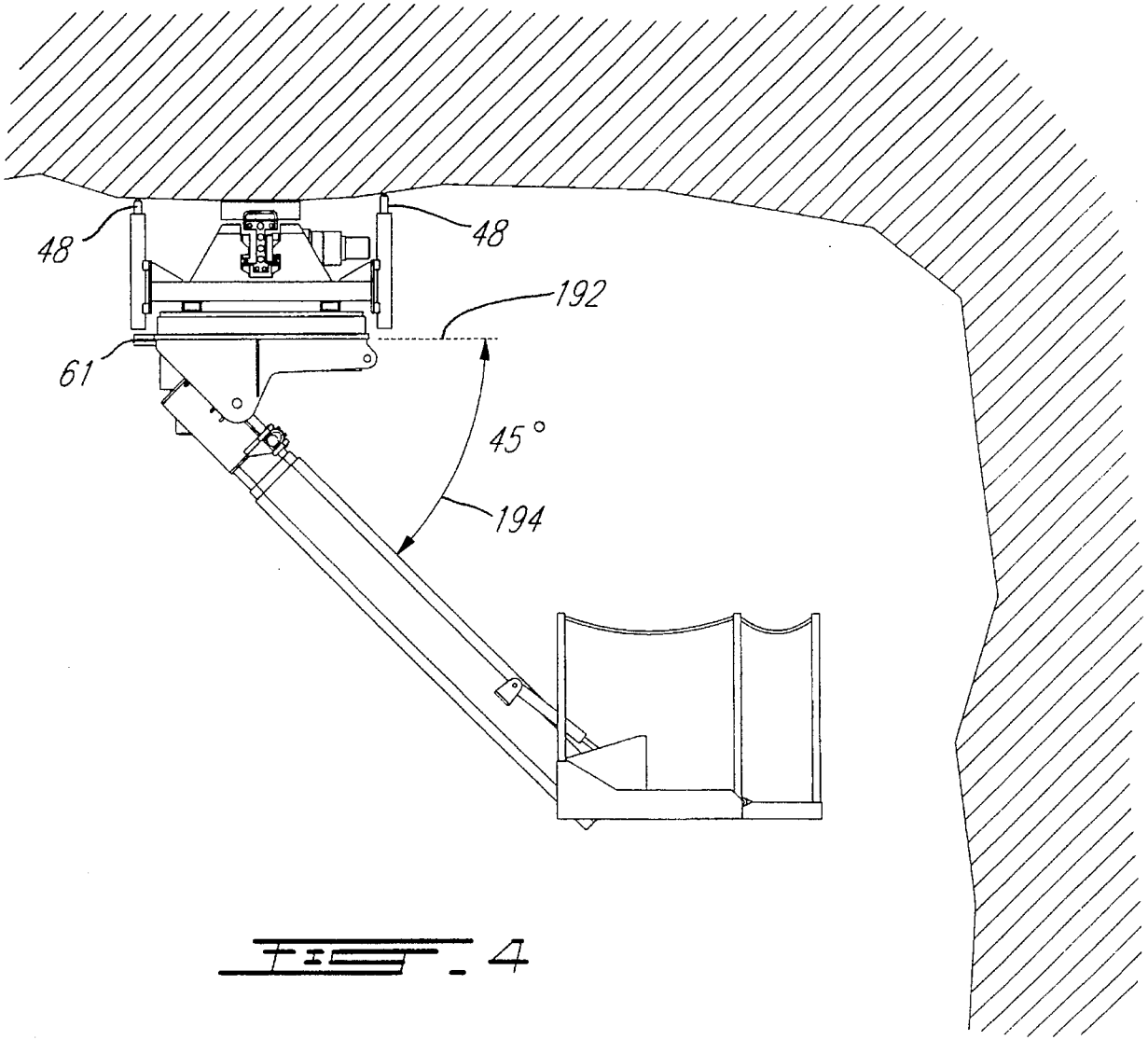
FIG. 4 is an end view of the working apparatus of FIG. 1 shown in proximity of a working area, illustrating up and down angular positioning of the boom transversely under longitudinal beams provided on the platform frame.

Referring now to the drawings, and more particularly to FIGS. 1 to 3, there is shown generally at 10 the displaceable working apparatus according to a first preferred embodiment of the present invention. The apparatus 10 comprises a guide rail generally designated by numeral 12, which is comprised of a plurality of connected guide rail sections 14 suspended from a roof surface 1 adjacent said guide rail. The apparatus as shown in FIGS. 2C and 4 is used as a mine working apparatus. Each rail section 14 is secured to the adjacent roof surface 1 by a flanged plate 20 having an upper part 22 being attached to the adjacent roof surface 1 through proper fastening means, such as rock bolts 23 as shown in FIG. 2C, for a mine working apparatus. The flange portion 24 of the plate 14 is welded or otherwise secured to a junction element 26 provided on an end of each rail section 14, which is coupled through bolt and nut assemblies 30 to a corresponding adjacent junction plate 28 welded or otherwise secured to the opposed end of each rail section 14.

Figure 18:
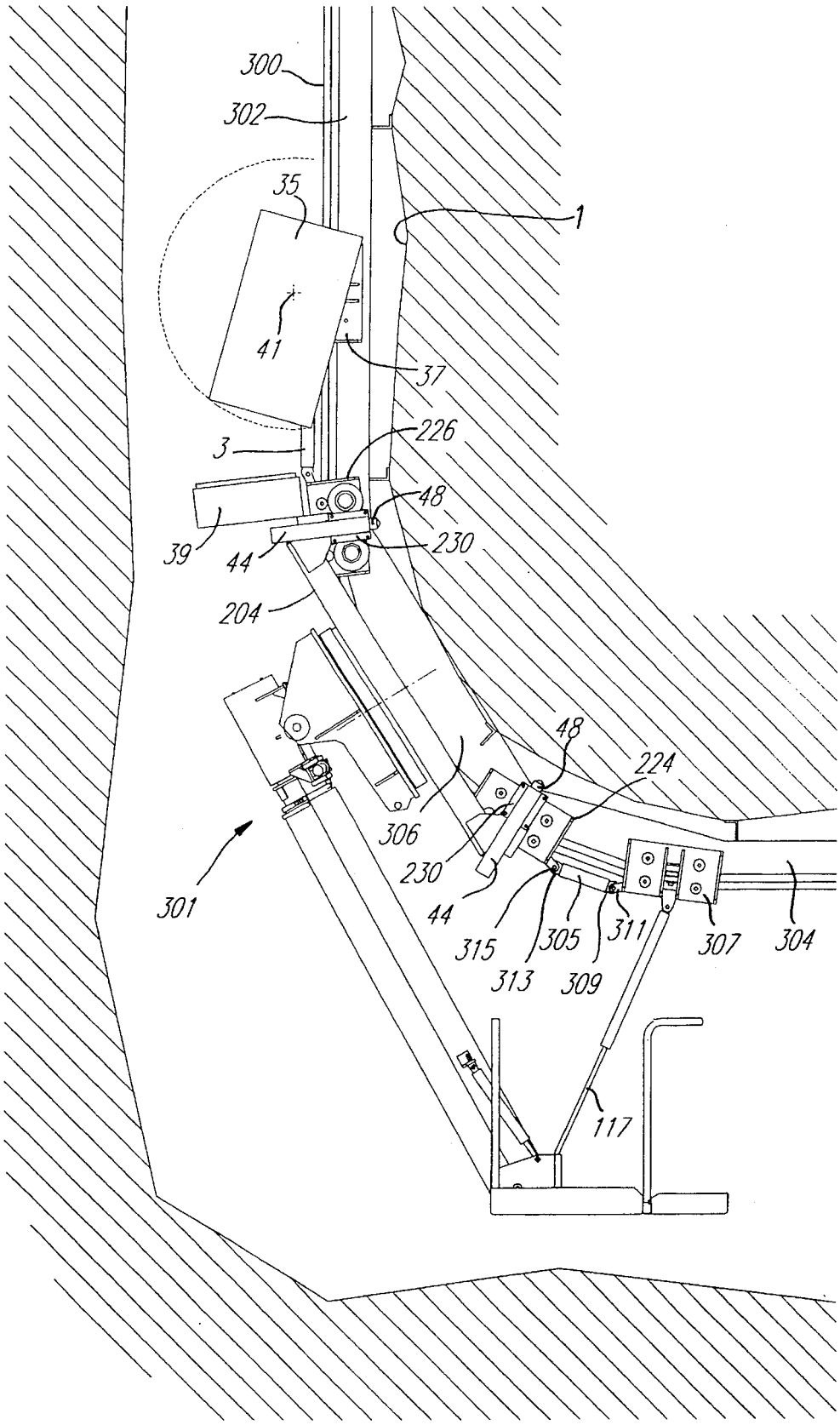
FIG. 18 is a front view of a displaceable working apparatus according to the second preferred embodiment of the present invention, showing the working platform in a transport mode along a curved rail portion.

The apparatus 10 further comprises a displaceable working platform 32 comprised of a main frame 34 of generally rectangular shape secured to a main support means, preferably comprising a pair of main support frames 36 and 38 movably secured to the rail 12 by means of upper and lower rollers 40 and 42 as later described in more detail. A driving means for displacing the working platform 32 along the rail 12 is comprised by driving units 33 mounted on the support frames and coupled with rail engaging means, as will be later described in more detail. The driving units are preferably electrical motors connected to a proper conventional electrical power supply means, which could be an electrical generator (not shown) fed by pressure fluid supply, such as a hydraulic compressor fuel engine (not shown), and are connected to a control unit (not shown) of a known type, which is used by an operator to control the displacement of the working platform 32. As shown in FIG. 18, which illustrates a second embodiment of the present invention, the electrical generator and hydraulic supply can be mounted within an enclosure 35 pivoting about an axis 41 and secured on a displaceable trailer pivotally attached to rear end of the frame 204 through a rear structural member 43, and suspended from the rail 300 by a support frame 37. The control unit can be mounted within an enclosure 39 secured on the working platform. Each driving unit is preferably coupled to a braking device (not shown) of a known construction connected to the control unit. It is to be understood that only one driving unit of a proper power rating can be provided.

As better shown in FIG. 2C, a stabilizing means is provided for immovably securing the main frame 34 to the adjacent roof surface 1. The stabilizing means comprises a plurality of telescopic extension posts 48 secured to the main frame 34, in respective corners on the outside of the main frame, by means of respective hydraulic cylindrical housings 44 secured to the main frame 34 through holding plates 46. Each telescopic extension post 48 is housed in telescopic manner in the corresponding cylindrical housing 44 and is independently extendible from an upper end of the cylindrical housing 44, by means of fluid power transmitted to the housing from the power unit connected to the control unit, as indicated before. In the example as shown in FIG. 2C, each telescopic extension post can be extended for engagement with the rock of adjacent roof surface 1 of a mining cavity, and can be independently extendible from an upper end 45 of the cylindrical housing 44 to control the angular position of the main frame 34 with respect to the guide rail 12. Each telescopic extension post has an arresting rod 50 having a pointed conical end for better engaging in a rock surface.

Figure 19:
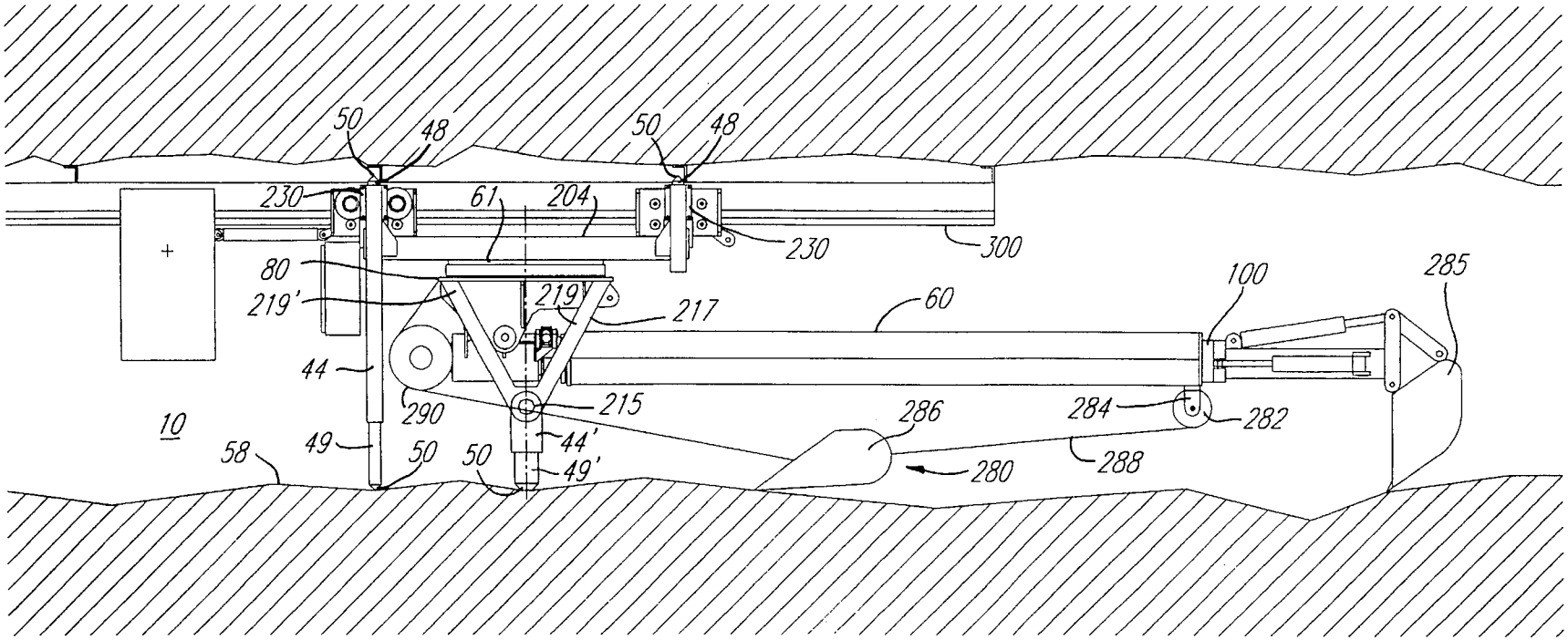
FIG. 19 is a partial perspective view of the extensible boom according to the present invention, showing a scraper element secured to the boom free end through a pulley and a cable driven by a winch provided on the platform main frame.

In order to provide better control of the angular position of the main frame 34 relative to the guide rail 12 and improved stabilization of the apparatus during working, and where a mine cavity, such as a drift or shaft, is provided with a floor portion in relative proximity of the rail, the apparatus can be further provided with one or more lower telescopic extension posts, such as lateral posts 49. In may also be provided with a central post 49 housed in a hydraulic cylindrical housing 44, which lower posts are adapted to be extended for engagement with the rock of adjacent mine floor surface 58, as can be seen on the second preferred embodiment of the working apparatus 10 as shown in FIG. 19, which will be later described in more detail. Each lower telescopic extension posts 49 and 49 has an arresting rod 50 having a pointed conical end for better engaging in a rock surface. So as to provide a control on the lateral positioning of the respective arresting rod on the adjacent rock surface, each telescopic extension post can be secured to the frame through laterally extendible mounting means, such as a telescopic transverse piston and cylindrical housing assembly (not shown), which can be operable through the control unit to displace laterally each post before engagement with the rock surface.

For safety purposes, the control unit is preferably provided with posts extension control means adapted to sense the actual position of a post between a retracted post position and a predetermined limit extended post position. In this manner, the control unit means enables an operator to command displacement of the platform along the guide rail only if a complete retracted position is sensed. Furthermore, the control unit enables an operator to command any movement of the boom only if an extended post position lower than the limit extended post position is sensed.

Referring to FIGS. 1 to 3, the rectangular main portion of the main frame comprises first and second beams 68 and 70 secured in spaced parallel relationship by first and second transverse structural members 72 and 74, through proper welding or other joining method as well known in the art. The apparatus 10 further comprises an extensible boom 60 pivotally secured to a rotating support base 61 positioned under the main frame 34 and secured thereto by means of attaching plates 76 welded on a fixed mounting plate 78 provided on the rotating base 61. The extensible boom 60 is pivotally secured to the rotating support base 61 through a main pivot assembly 75 mounted on a pair of parallel spaced support flanges 77 and 77 secured on a rotating mounting plate 80 provided on the support base 61 through bracing members 79. The extensible boom 60 is caused to be rotated on the support base 61 by a reduction gearing motor 81 coupled to the rotating mounting plate 80 though a gear 82 mounted between the mounting plates 78 and 80 and being in alignment with a common central rotation axis 84. To provided accurate boom rotation control, the reduction gearing motor is preferably an electrical motor connected to the electrical generator fed by fluid power, as indicated before. The reduction gearing motor is connected to the control unit power unit as mentioned before.

Figure 5:
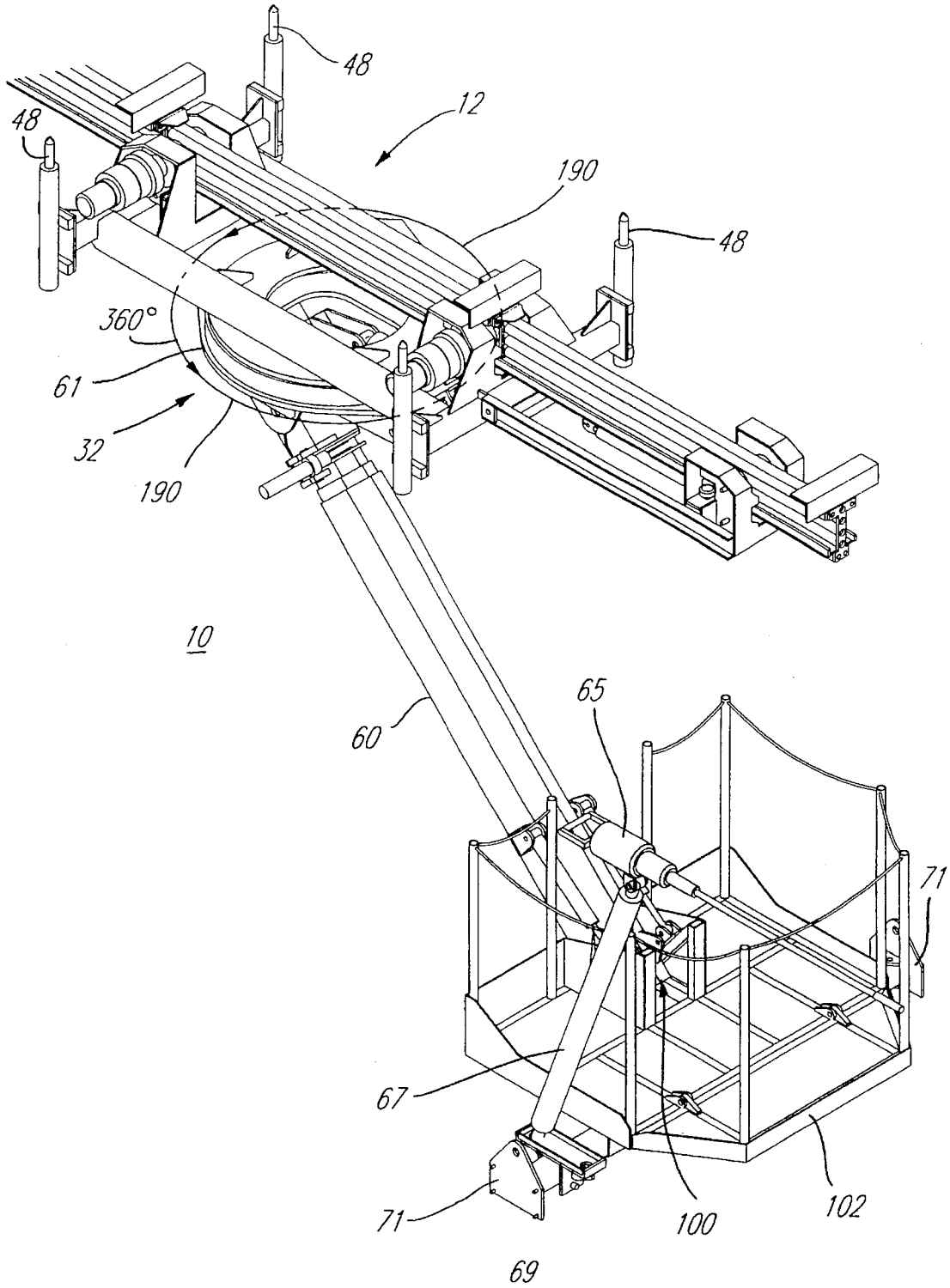
FIG. 5 is a perspective view of the working apparatus of FIG. 1 shown in a working mode, illustrating the platform with the extensible boom being lowered at a angle with respect to the support base of the boom, and showing a drill attached to a working platform provided at the boom free end.
Figure 8:
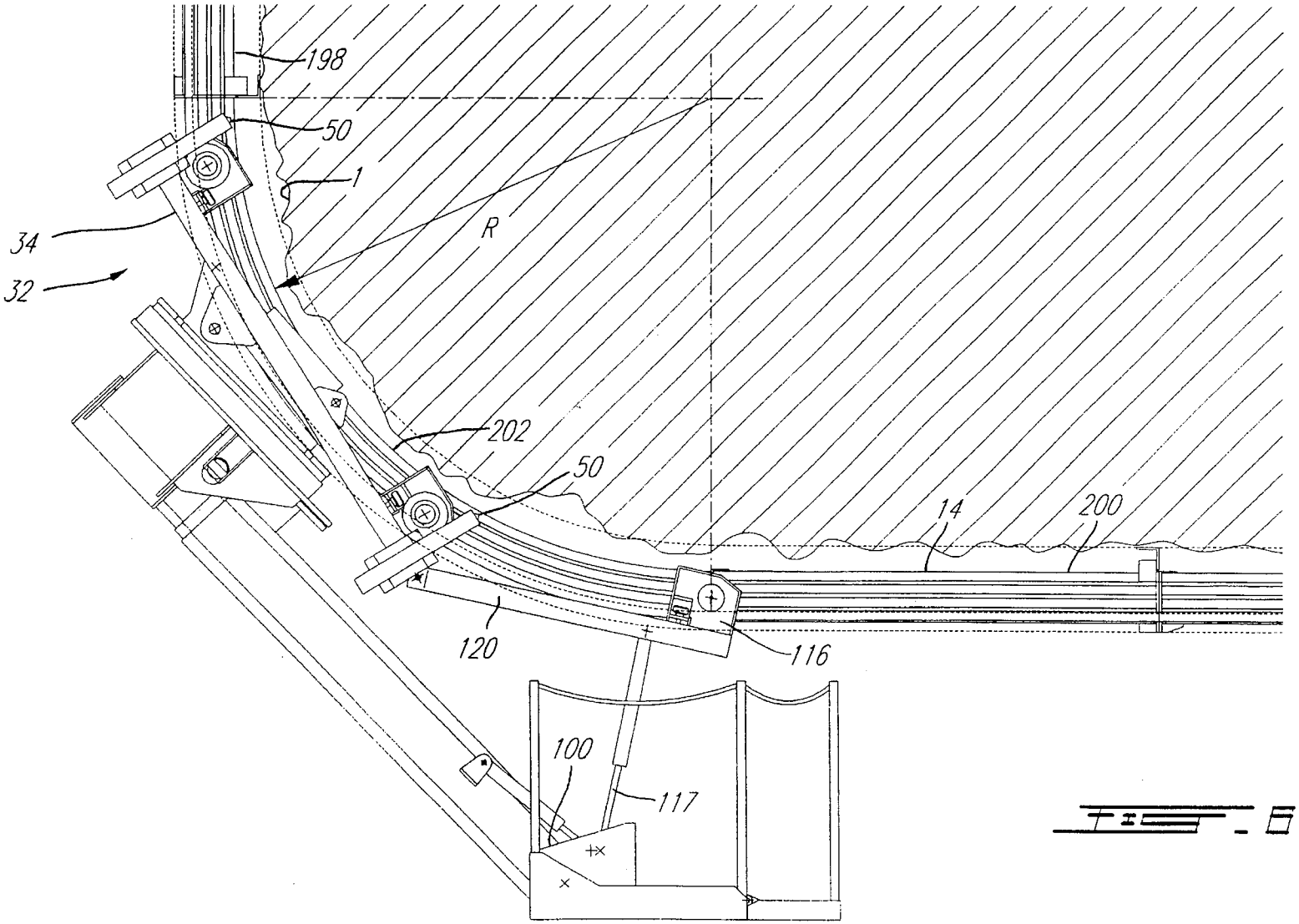
FIG. 8A is a perspective view of a boom support frame provided on the apparatus as shown in FIG. 1.
FIG. 8B is a partial cross-sectional front view along section line VIII—VIII of FIG. 2C, showing a first boom section having its rear end portion engaged into the boom support frame.

In a preferred embodiment, the boom 60 is laterally rotatable on the rotating support base 61 over an arc of 360°, as indicated by arrow 190 in FIG. 5. A means to regulate the angular position of the boom 60 is provided, in the form of one or two pistons 86 secured between the rotating support base 61 and a boom support frame 59, through a front pivot assembly 88 connected to respective outer ends of the piston cylindrical housing 89, and a rear pivot assembly 90 connected to a pair of lever elements each comprising parallel spaced flanges 92 and 92' rigidly secured to the boom support base through welded holding plate 94 and bracing element 96. The regulation of the boom angular position is provided through the same power and control unit as indicated before.

In a preferred embodiment, the boom 60 is angularly positionable up or down to an angle of about 45° below a horizontal axis 192 defined by the rotating support base 61, as indicated by arrow 194 in FIG. 3 and 4. A shown in FIG. 3, the boom 60 is further angularly positionable up or down to an angle of about 15° over the horizontal axis 192 whenever the boom 60 is positioned transversely under any of the structural members 72 and 74, as indicated by arrow 196. The extensible boom 60 is preferably comprised of three straight boom sections 62, 64 and 66 disposed one within another. A base portion of the first boom section 62 is engaged in a housing 98 provided on the boom support frame 59, in a such manner that the boom can be rotatable about its longitudinal axis on the boom support frame, by means of an actuating device 63, as will be later explained in more detail. The third boom section has a free end 100 holding a working element 102 pivotally secured thereto through a pivot assembly 104. The angular position of the working element 102 with respect to the boom free end 100 is performed by one or two pistons 103 pivotally secured between the working element 102 through pivot attachments 105, and the third boom section 66 through pivot attachments 106 connected to piston housings 108. In the particular example as shown in FIG. 1 to 4, a working end platform for supporting a load or a person thereon is shown. This platform can be provided with a control panel (not shown) connected to the control unit, for operating the boom 60. Depending upon the type of work required, the boom free end 100 can be provided with other remotely operable tools, such as drill, scraper, bucket, hooks, scaler, sand or water jet device, etc.

Referring now to FIG. 5, a remote operated tool, such as a drill 65 of a known construction, is attached through a support member 67 secured to a working end platform 102 pivotally secured at the boom free end 100, as indicated before. The working end platform 102 has a pair of lateral stabilizing means in the form of a telescopic extension post 69 extending parallel to an horizontal plane thereof for immovably securing the end working platform 102 to opposed lateral surrounding surfaces of a mine cavity (not shown) through engagement with end plates 71.

Figure 9A:
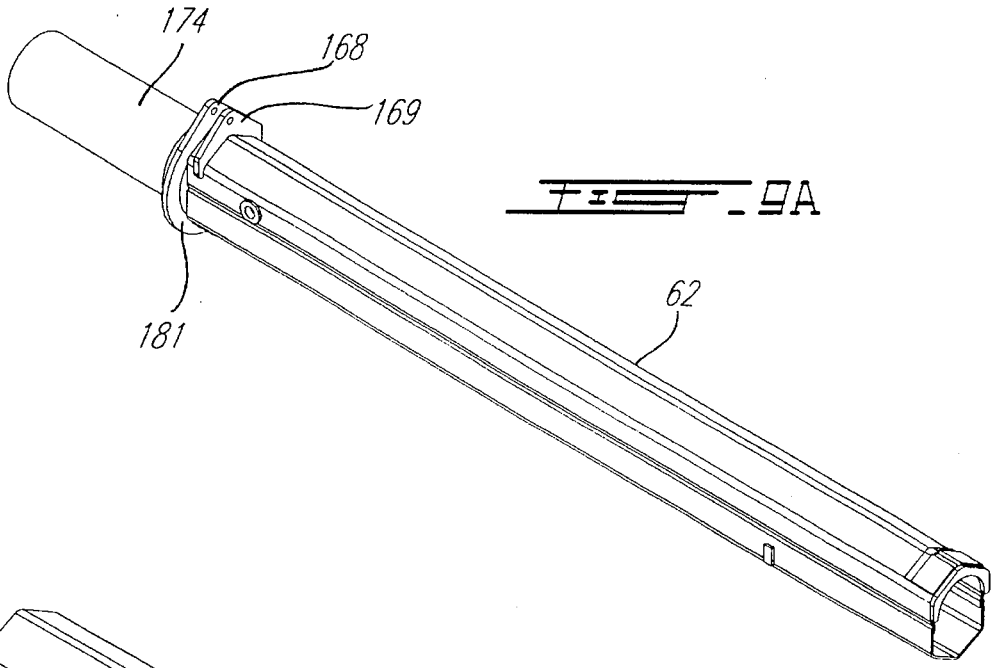
FIG. 9A and 9B are respectively perspective views of preferred design for first and free end sections of the extensible boom provided on the apparatus of the present invention.
Figure 9B:
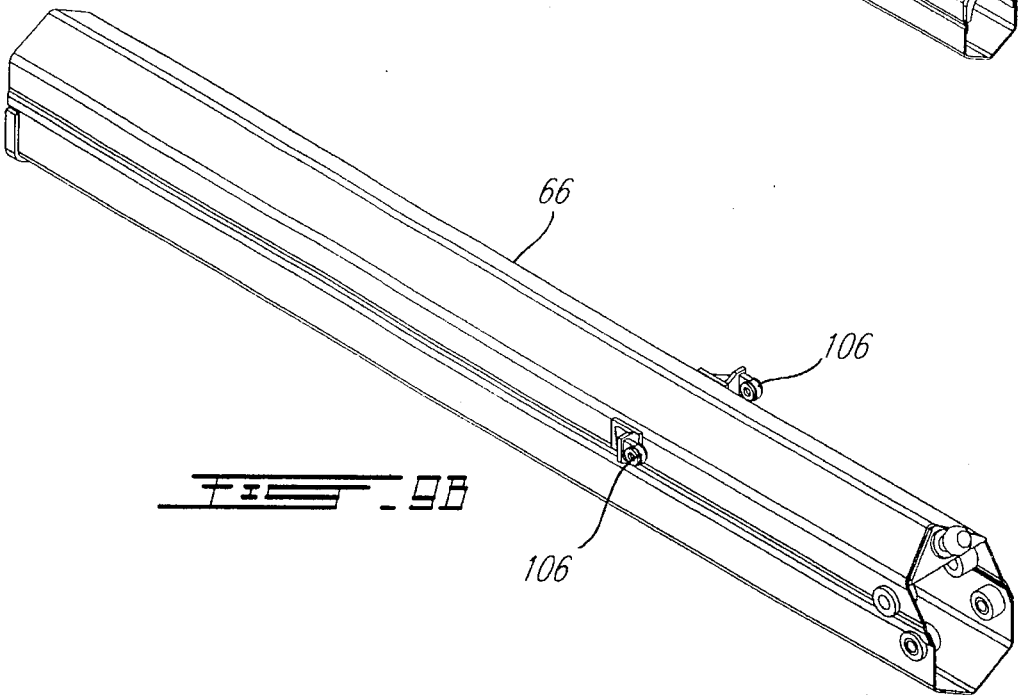
Figure 9C:
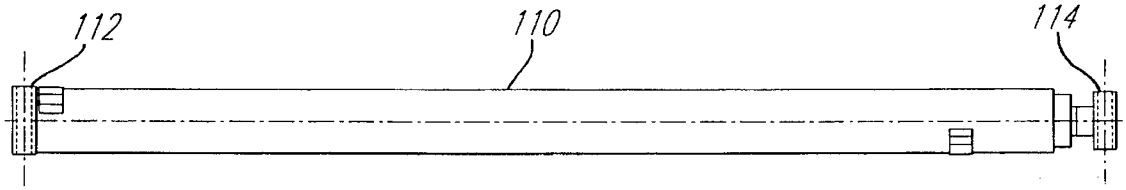
FIG. 9C is a front view of a telescopic hydraulic cylinder designed to be housed in the boom as provided on the apparatus of the present invention.

Referring to FIGS. 1 to 3 and 9C, the extension of the boom is preferably provided by a fluid driven piston device, as shown at numeral 110 in FIG. 9C, which extends longitudinally within the boom 60 and having opposed ends 112 and 114 respectively connected to an internal wall provided within the base portion of the first boom section 62 and an internal wall provided within the outer end of the third boom section 66, which end defines the boom free end 100. The piston device is connected to the power and control units as indicated before. Alternately, an external fluid driven piston device such as the piston device described in U.S. Pat. No. 5,113,969 can be used, which patent is incorporated herein by reference.

Referring to FIGS. 1 to 2B, the apparatus 10 further comprises a boom free end support means in the form of a boom end support frame 116, with an extendible connecting means connected to a pivot attachment 123 secured to the boom end support frame 116, in the form of a piston 117 housed in a telescopic manner within a hydraulic cylindrical housing 119. This connecting means provides detachable connection between the boom end support frame 116 and a pivot attachment 121 secured to the boom free end 100. The piston 117 is connected to the power and control unit as indicated before, to control extension thereof. This connecting means can also be provided with a remotely operated device (not shown) connected to the control unit for selectively engaging and releasing the connection.

As shown in FIG. 6, the extension of the piston 117 is adjusted according to the orientation of the displaceable working platform 32 with reference to the guide rail 14, which orientation depends on the specific longitudinal profile of the guide rail 14. In FIG. 6, there is shown straight guide rail sections 198 and 200 secured to an adjacent rock surface 1 of a mine cavity, which are connected to both ends of a curved guide rail section 202, as indicated before. In this example, the curved guide rail section 202 has a circular longitudinal profile of internal radius R, but guide rail sections having any continuous longitudinal profile for adapting the shape of the surrounding surface can be used according to the present invention. In FIG. 6, the working platform 32 is in a transport mode with the stabilizing extension posts and arresting rods 50 being retracted, and the piston 117 being pivotally connected to the boom free end 100, in an extended position adapted to distance variation due to varying rail orientation. It can also be seen that from FIG. 6 that the front structural member, for which only its structural beams 120 is shown in FIG. 6, is angularly positioned with reference to the main frame 34 for better adaptation to varying rail orientation, enabling the boom end support frame 116 to follow the rail portion ahead of the main frame 34.

Referring now to FIG. 9B, according to an alternate design of the third boom section 66, a pivot attachment in the form of a ball 125 is adapted to receive a socket portion (not shown) attached to a lower end of the extendible connecting means. For safety purposes, the control unit of the apparatus preferably comprises driving control means adapted to sense a securing condition of said boom free end 100 on the boom end support frame 116. Such condition sensing can be provided using a circuit path (not shown) passing through the pivot attachment and the extendible connecting means lower end. In this manner, the control unit enables an operator to command displacement of the platform along the guide rail only if a securing condition is sensed. Furthermore, the control unit prevents operation of the reduction gear motor controlling the rotation of the boom and operation of the means regulating the angular position of the boom if a securing condition is sensed.

Returning to FIG. 1 to 2B, it can be seen that the boom end support frame 116 is movably secured to the rail 12 by means of rollers 118 similarly as indicated before regarding the main support frames 36 and 38. The boom end support frame 116 is pivotally connected to the transverse structural member 72 of the main frame 34 by means of a front structural member, which is in the form of a pair of parallel spaced structural beams 120 and 120. The beams 120 and 120' have respective first ends connected to both sides of the boom end support frame 116 and respective second ends connected to pivot attachment 122 and 122 secured on the transverse structural member 72.

Figure 7:
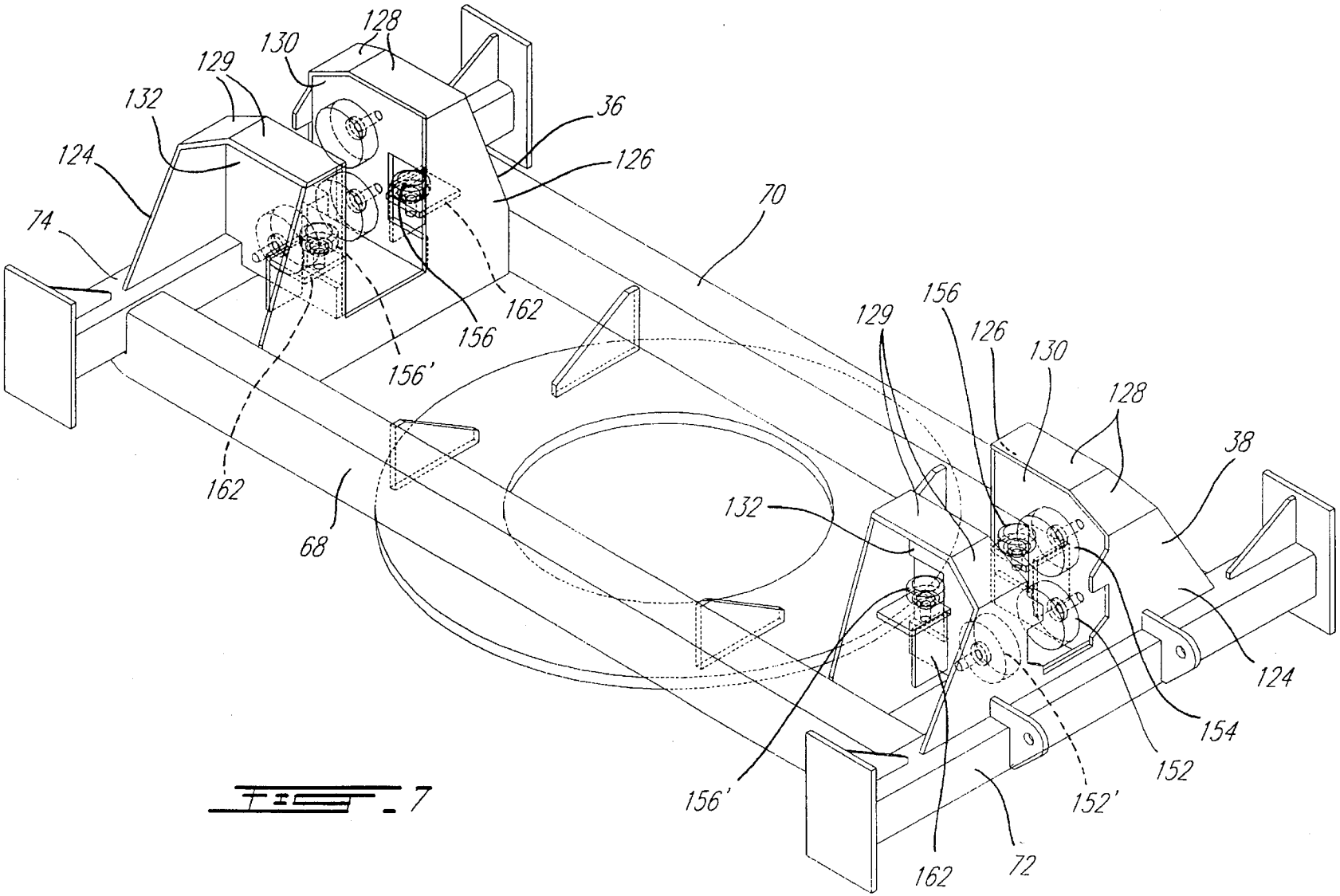
FIG. 7 is a perspective view of the main frame and support frames assembly provided on the apparatus as shown in FIG. 1.
Figure 8A:
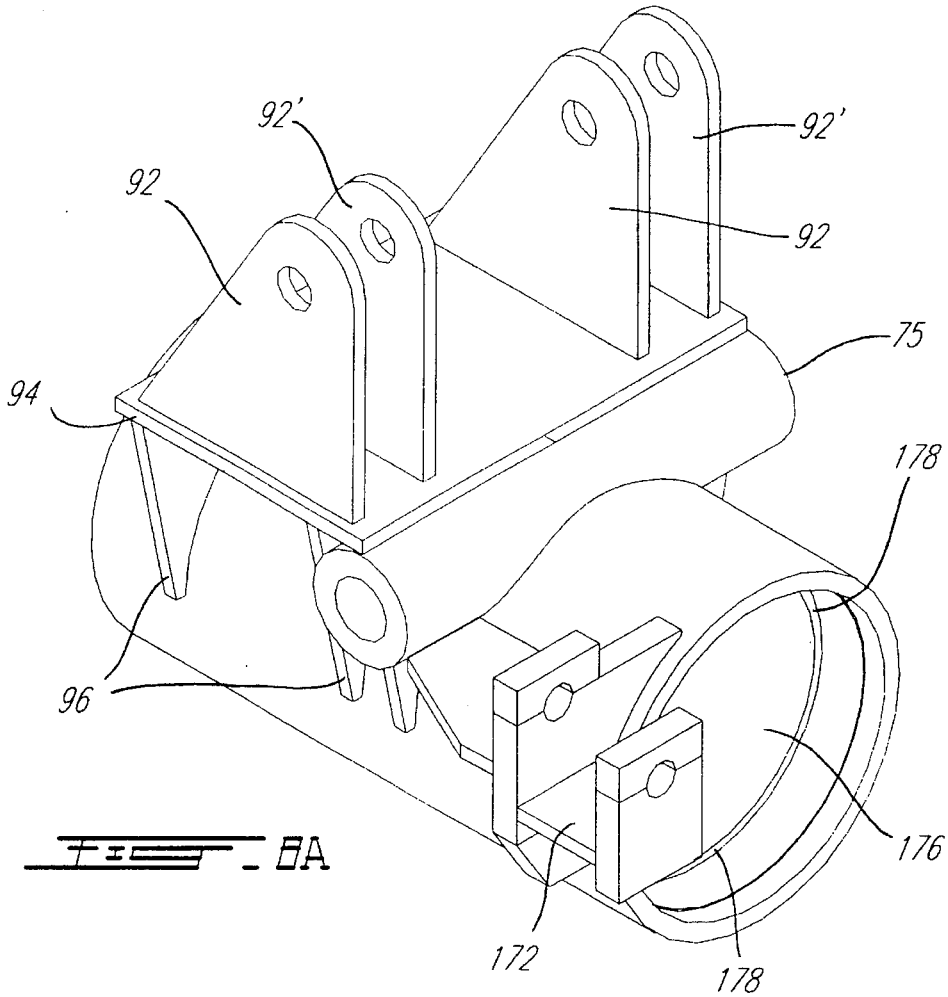
Figure 8B:
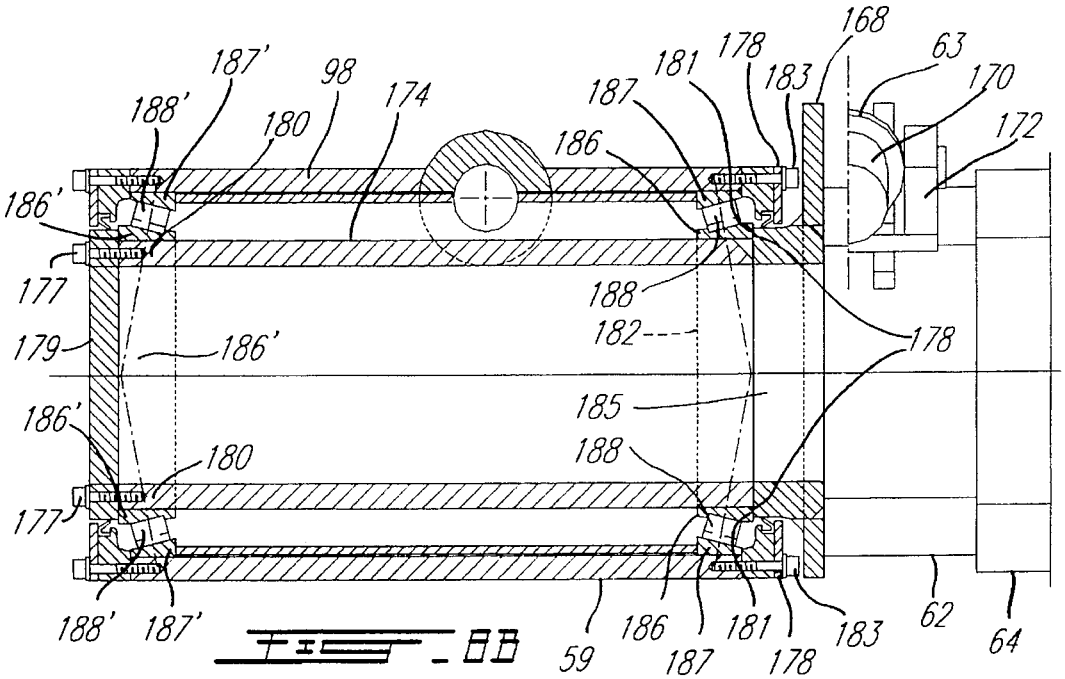

Turning now to FIG. 7, the main support frames 36 and 38 comprise a pair of parallel spaced front and rear walls 124 and 126 respectively secured at lower edges thereof to the corresponding transverse structural members 72 and 74 and to the beams 68 and 70. The front and rear walls 124 and 126 are connected at upper edges thereof by one or more connecting walls 128 and 129. The main support frames 36 and 38 have first and second opposed side walls 130 and 132 secured in space parallel relationship to peripheral edges of the walls 124, 126, 128 and 129, defining a channel 134 traversed by the guide rail 12, as better shown in FIG. 2C.

Figures 10, 11, 20:
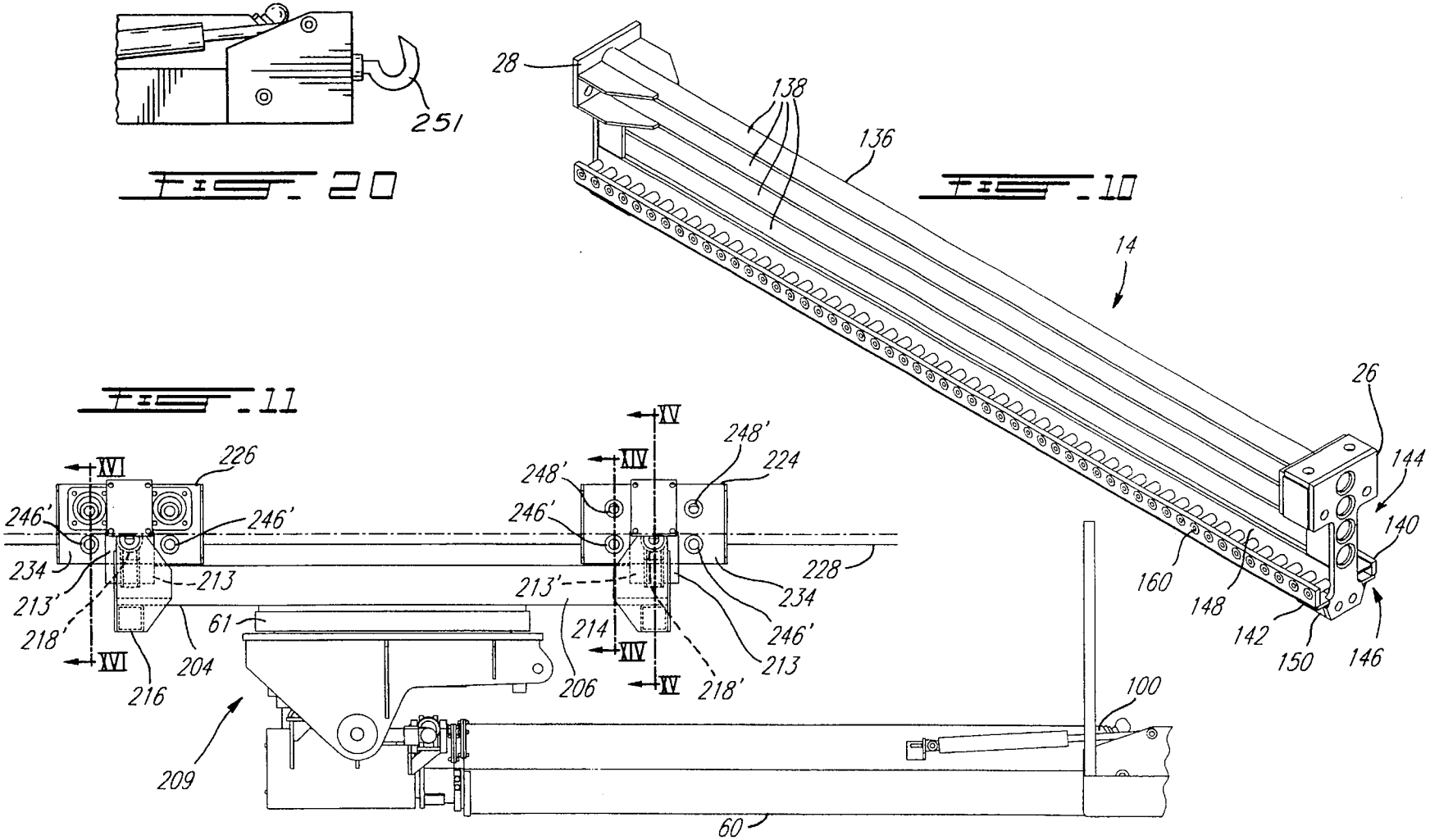
FIG. 10 is a perspective view of a preferred design for the guide rail section provided on the apparatus according to the present invention.
FIG. 11 is a partial front view of a displaceable working apparatus according to a second preferred embodiment of the present invention, illustrating displacement of the apparatus along a curved rail portion.
FIG. 20 is a partial view of the end of the boom with a hook being attached thereto as a working element.

Referring now to FIG. 10, each rail section 14 preferably includes an elongate core portion 134 in the form of a plurality of superimposed structural pipes 128 secured at opposed en thereof to the junction element 26 and the junction plate 28. Secured to the junction element 26 and junction plate 28 are first and second elongated guide members 140 and 142 extending in a spaced parallel relationship along respective sides of the core portion 136. It can be seen that upper and lower parts of the first guide member 140 respectively defines first upper and lower tracks 144 and 146. Similarly, upper and lower parts of the second guide member 142 respectively defines second upper and lower tracks 148 and 150.

Returning to FIG. 7, the main support frames 36 and 38 are provided with roller means, which preferably includes a pair of lower opposed rollers 152 and 152 respectively mounted on the side walls 139 and 132 and engaging the first and second lower tracks 146 and 150 shown in FIG. 10. In a preferred embodiment as shown in FIGS. 1 to 7, mounted on the first side wall 130 is an upper roller 154 engaging the first upper track 144 shown in FIG. 10. As indicated before, the driving means includes first and second driving units 33 respectively mounted on the second side walls 132 of the main support frames 36 and 38. Each driving unit 33 has a driving shaft provided with a teethed end 158, as shown in FIG. 2C, for engaging a rack bar 160, as show in FIG. 10, which is comprised in the rail second guide member 142.

In an alternate embodiment using a single driving unit 33 mounted either on main support frames 36 or 38, both main support frames include a pair of lower opposed rollers 152 and 152 mounted as indicated before. The roller means provided on one of the support frames 36 and 38 further includes a pair of upper opposed rollers similar than lower rollers 152 and 152, which are mounted on the first and second side walls 130 and 132 for engagement with the first and second upper tracks 144 and 148 shown in FIG. 10. The other one of support frames 36 and 38 further includes an upper roller 154 mounted on the first side wall 130 for engagement with the first upper track 144. A single driving unit 33 is mounted on the second side wall 132, which unit has a driving shaft provided with a teethed end 158, as shown in FIG. 2C, for engaging the rack bar 160, as show in FIG. 10.

Figure 13:
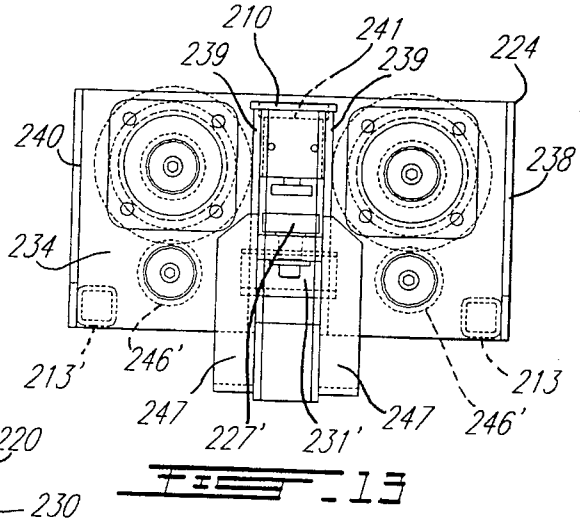
FIG. 13 is a front view of a support frame provided with driving motors and rollers as shown in the apparatus of FIG. 11.
Figure 15:
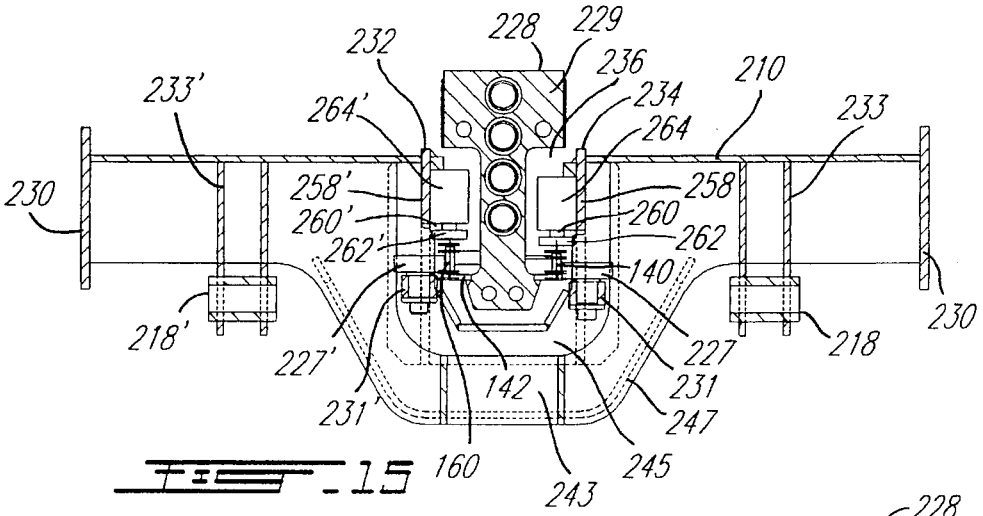
FIG. 15 is a partial cross-sectional view of the support frame, locking devices and transverse structural member assembly along section line XV—XV of FIG. 11.

Referring to FIG. 10, 13 and 15, for both of embodiments herein described, to enhance lateral stability, the roller means preferably further includes a pair of lateral opposed rollers 156 and 156 respectively mounted on the first and second side walls 130 and 132 through attachments 162. The lateral rollers 156 and 156 respectively abut on side portion of the first and second elongated guide members 140 and 142, corresponding for the member 142 to the side portion of the rack bar 160, as shown in FIGS. 2C and 10.

Referring now to FIG. 2C, 8A, 8B and 9A, rotation of the boom 60 about its longitudinal axis on the boom support frame 59 will be explained. As shown in FIG. 2C, the actuating device 63 comprises a piston 164 connected to a pivot assembly 166 secured to a pair of spaced connecting flanges 168 and 169 rigidly attached on the first boom section 62, as shown in FIG. 9A. The piston 164 is housed in a telescopic manner within a hydraulic cylindrical housing 170 provided on the actuating device 63, and pivotally secured to the boom support frame 59 through an attachment 172. The base portion 174 of the first boom section 62 is engaged in the housing 98 provided on the boom support frame 59. The external diameter of the engaging part of the end base portion 174 is chosen to fit in the opening 176 provided in the housing 98 and defined by a front inner annular race 186 provided on a bearing assembly 182 mounted within the housing 98. The base portion 174 is further provided with an enlarged section 185 having an external diameter larger than the inner bearing annular race 186, thereby providing a rigid abutment on edges surface 178 of the front annular race 186.

The connecting flange 168, which is positioned between the enlarged section 185 and the remaining portion of the first boom section 62, is provided with a sleeve portion 181 being adjacent to a sleeve 178 mounted on the front portion of the boom support frame 59 through bolts 183, in a such manner than any further engagement of the base portion 174 within the housing 98 is prevented. The end 180 of base portion 174 is secured by bolts 177 to a bottom plate 179 mounted on a rear inner race 186 provided on the bearing assembly 182. The bearing assembly has stationary front and rear annular outer races 187 and 187. Bearing elements 188 and 188 engage the inner races 186, 186 and outer races 187, 187 providing rotation of the boom base portion 174 within the housing 98.

Referring now to FIG. 11 to 16B, a second preferred embodiment of the present invention will be described, in which the main frame and the main support frames have been modified. As shown in FIG. 11, the apparatus 10 comprises a displaceable working platform 209 comprised of a main frame 204 and having a boom 60 provided with a working element at a free end 100 thereof, and pivotally connected to a rotating support base 61, as indicated before.

As shown in FIG. 18 and 19, a stabilizing means is provided for immovably securing the main frame 204 to the adjacent roof surface, as indicated before, in the form of a plurality of upper telescopic extension posts 48 having arresting rods 50 and being secured to opposed ends 220 and 222 of the transverse structural members 210 and 212, by means of respective hydraulic cylindrical housings 44 and secured to the structural members 210 and 212 through holding plates 230.

As indicated before with reference to FIG. 19, to provide better control of the angular position and improved stabilization of the apparatus during working, and where a mine cavity is provided with a floor portion surface 58 in relative proximity of the rail 300, the apparatus can be further provided with one or more lower telescopic extension posts, such as lateral posts 49 and central post 49 housed in the hydraulic cylindrical housing 44, which are adapted to be extended for engagement with the rock of adjacent mine floor surface 58. In the example shown in FIG. 19, a pair of hydraulic cylindrical housings 44 secured to the rear structural member 212 are adapted to receive trough a lower portion thereof lower telescopic extension posts 49. Each lower telescopic extension post 49 can be extended for engagement with the rock of adjacent mine floor surface 58, and can be independently extendible from a lower upper end 45 of the cylinder housing 44, in a same manner as earlier described. The hydraulic cylindrical housing 44 is pivotally secured to the main frame by means of a pivot assembly 215 provided as a transverse member of mounting frame 217 having opposed pair of legs 219 and 219 rigidly secured to the rotating mounting plate 80 provided on the support base 61.

In use, the cylindrical housing 44 is lowered to a vertical position as shown in FIG. 19, and the post 49 is free to rotate within the housing 44 as the boom is laterally rotated on the rotating support base 61. Each lower telescopic extension posts 49 and 49 has an arresting rod 50 having a pointed conical end for better engaging in a rock surface. So as to provide a control on the lateral positioning of the respective arresting rod on the adjacent rock surface, each of the telescopic extension posts 48 and 49 can be secured to the corresponding transverse structural member 210 and 121 through laterally extendible mounting means, as indicated before, which can be operable through the control unit to displace laterally each post before engagement with the rock surface.

In the particular example as shown in FIG. 11, a working end platform for supporting a load or a person thereon is shown. As indicated before, depending upon the type of work required, the boom free end 100 can be provided with other remotely operable tools such as a hook 251 as shown in FIG. 20. Returning to FIG. 19, a mine working platform adapted for mine floor scraping is shown, on which the front structural member and boom end support frame have been removed for convenience. The mine working apparatus 10 comprises, as a working element, a scraping element 280 having a pulley 282 pivotally secured to a support member 284 at the boom free end 100, and having a scraping bucket 286 attached to a cable 288 connected to a winch unit 290 mounted on the rotating support base 61. In use, the scraping bucket 286 is caused to be displaced along the boom 60 for scraping a flour portion 58 of a mine drift, thereby collecting ore or rock fragments accumulated thereon (not shown). The boom free end 100 can be also provided with an articulated bucket 285 of a known construction, to break off the rock fragments before scraping.

Returning to FIG. 11 to 16B, the support base 61 is mounted under a main frame 204 having a substantially rectangular main portion including first and second beams 206 and 208. As better shown in FIG. 12, the beams 206 and 208 are secured in spaced parallel relationship by first and second pivoting transverse structural members 210 and 212, and preferably by additional pair of transverse structural members 214 and 216 having opposed ends rigidly secured to the first and second beams 206 and 208. Rigidly mounted on the transverse structural members 210 and 212 is a support means in the form of front and rear main support frames 224 and 226, movably secured to the rail 228 by means of rollers as later described in more detail. The main support frames 224 and 226 comprise first and second opposed side walls 232 and 234 rigidly secured in space parallel relationship by transverse member 213 and 213, as better shown in FIG. 13, and by a pair of parallel spaced front and rear walls 238 and 240.

In the example shown, the main support frames 224 are provided with two spaced pairs of opposed upper roller mounting openings 233, and two pairs of opposed lower roller mounting openings 235. The main support frame 226 is similar than the main support frames 226, excepted that an it comprises two spaced upper roller mounting openings 233 and two driving unit mounting frame 237 defining openings 245.

Figure 12:
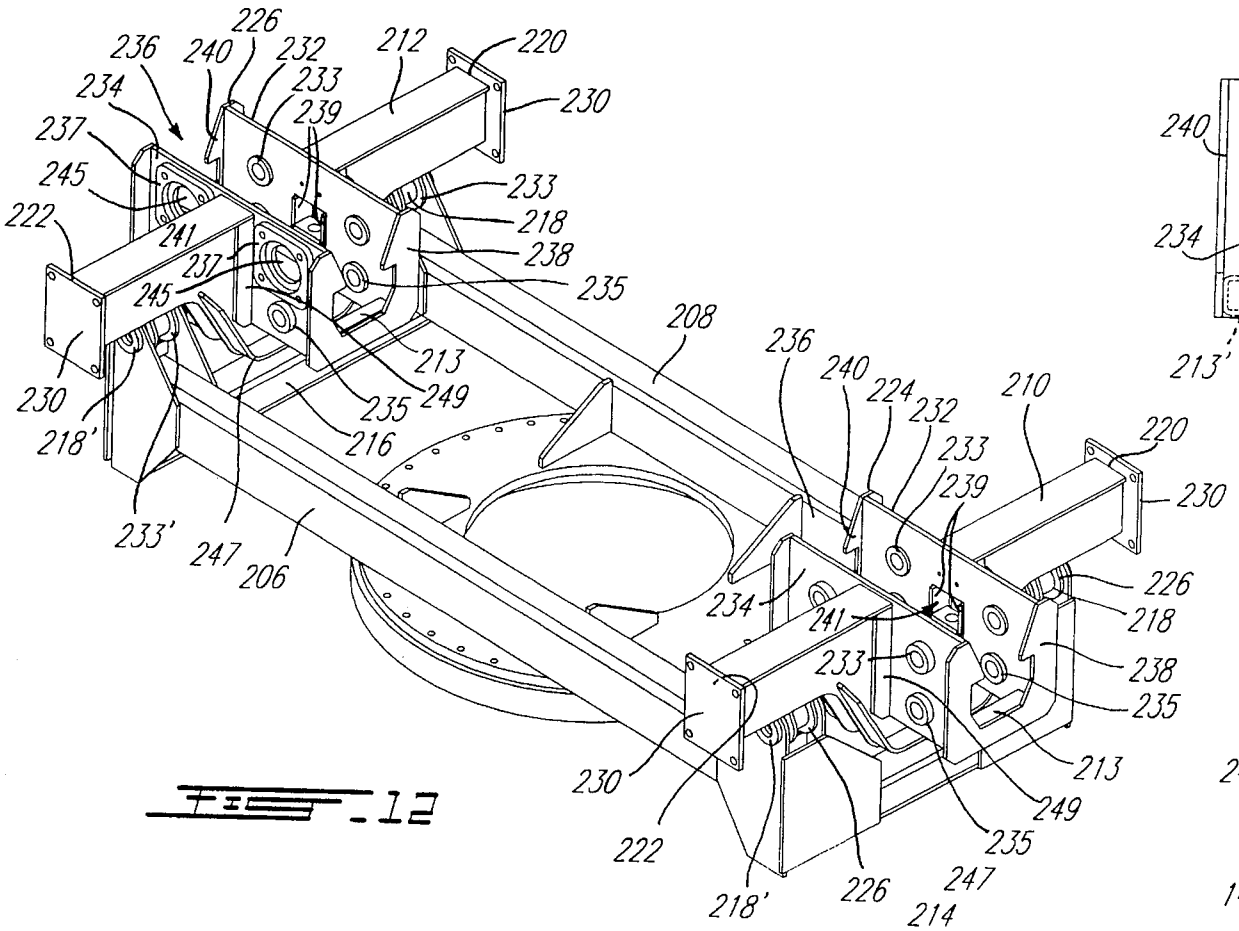
FIG. 12 is a perspective view of the main frame and support frames assembly as provided in the apparatus of FIG. 11.

As will be described later in more detail, alternate configurations of rollers and driving units can be implemented. As shown in FIG. 12 and 15, the opposed side walls 232 and 234 rigidly mounted within a central receiving cavity 245 provided on the transverse structural members 214 and 216, by means of a pair of opposed mounting plates 239 inset into corresponding openings 241 made on the opposed side walls 232 and 234, and having lateral edges being aligned with corresponding edges of a pair of mounting members 249 secured to external faces of opposed side walls 232 and 234. The opposed side walls 232 and 234 defines a channel 236 traversed by the guide rail 12, as better shown in FIG. 15. The lower portion 243 of the transverse structural members 214 and 216 are strengthened by means of a pair of parallel spaced flanges 247 secured on both sides thereof. The transverse structural members 210 and 212 are secured to beams 206 and 208 through rear and front pivot means in the form of a pair of opposed pivot assemblies 218 and 218.

The pivot assembly 218 is disposed between one end 220 of the corresponding structural members 210 and 212 and the corresponding support frames 224 and 226, while the pivot assembly 218' is disposed between the other end of the corresponding structural members 210 and 212 and the corresponding support frames 224 and 226. The beams 206 and 208 are connected to corresponding pivot assemblies 218 and 218 by means of a pair of mounting means in the form of flanged attachments 233 and 233 having respective first end secured to the beams 206 and 208, and respective second end secured to the opposed pivot assemblies 218 and 218.

The apparatus according to the second embodiment is also provided with main stabilizing means preferably in the form of two pairs of telescopic extension posts identical than those described before regarding the first embodiment as shown in FIGS. 1 to 5. These telescopic extension posts are secured through holding plates 230 to respective ends of the transverse structural members 210 and 212. As indicated before, being connected to the power and control units provided on the apparatus, the extension posts are extended for engagement with a ceiling portion of a mine cavity, and are independently adjusted to control the angular position of the main frame 204 relative to the guide rail 228. Alternately, as indicated before, the stabilizing means may comprise two or four pairs of opposed telescopic extension posts secured to respective ends of one or both of the transverse structural members 214 and 216, providing engagement with both floor and ceiling portion of a mine cavity. The second embodiment preferably uses the same rail sections as described before with reference to FIG. 10.

Figure 14:
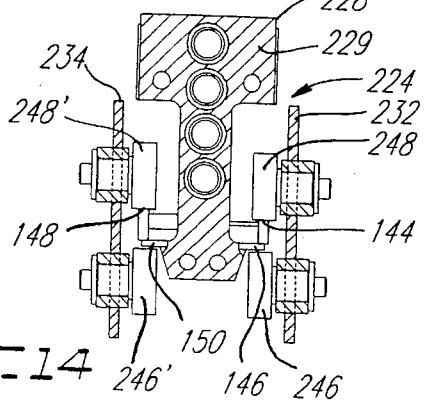
FIG. 14 is a partial cross-sectional view of the support frame and rollers along section line XIV—XIV of FIG. 11.

Referring now to FIG. 11 and 14, in the preferred embodiment shown, the main support frames 224 and 226 are both provided with a roller means having two parallel spaced pairs of lower opposed rollers 246 and 246 mounted on opposed side walls 232 and 234 and engaging the first and second lower tracks 146 and 150 provided on the rail 228. For the purposes of illustration, in FIGS. 14 to 17, the rail is shown as cross-sectional view of a rail junction element 229. The roller means of the front main support frame 224 further includes two parallel spaced pairs of upper opposed rollers 248 and 248 mounted on the opposed side walls 232 and 234 and engaging the first and second upper tracks 144 and 148.

Figure 16A:
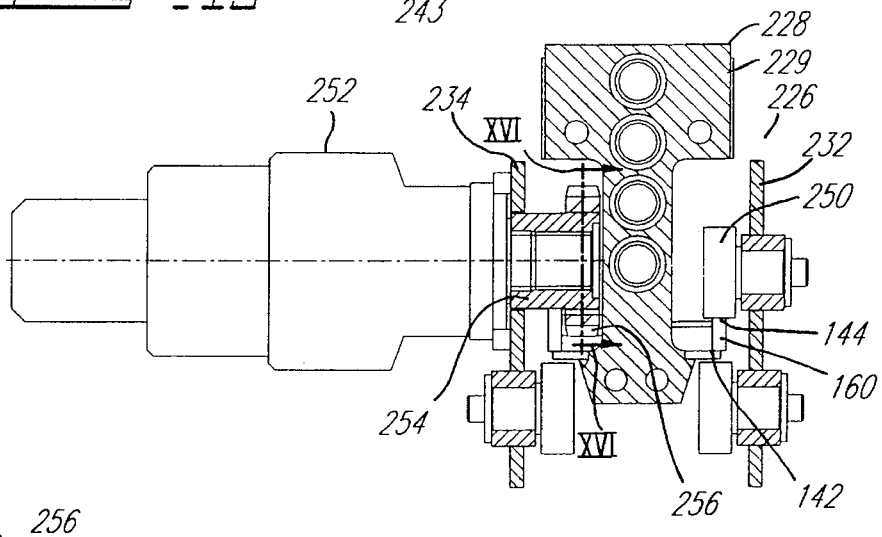
FIG. 16A is a partial cross-sectional view of the support frame, rollers and driving motor assembly along section line XVI—XVI of FIG. 11.
Figure 16B:
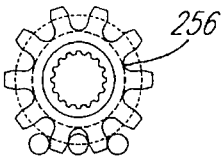
FIG. 16B is a partial cross-sectional view along section line XVI—XVI of FIG. 16A, showing the teethed end provided on the driving shaft of the driving motor as shown in FIG. 16A.

As shown in FIG. 16A, the roller means of the main support frame 226 further includes two parallel spaced upper rollers 250 mounted on the first side wall 232 and engaging the first upper track 144. In this embodiment, the driving means is comprised by a pair of parallel spaced driving units 252 mounted on the second side wall 234 of the main support frame 226. Each driving unit 252 has a driving shaft 254 provided with a teethed end 256, as better shown in FIG. 16B, for engaging a rack bar 160 comprised in the rail second guide member 142. It is to be understood that the driving units 252 can be alternately mounted on the front main support frame 224. So as to enhance lateral stability of the main support frames 224 and 226 as they are moving along the rail 228, the roller means preferably further includes a pair of lateral opposed rollers 227 and 227 respectively mounted on the first and second side walls 232 and 234 through attachments 231, as shown in FIG. 15. The lateral rollers 227 and 227 respectively abut on side portion of the first and second elongated guide members 140 and 142, corresponding for the member 142 to the side portion of the rack bar 160.

In a further alternate design, the apparatus according to the second preferred embodiment as described before can be provided with a main support frame 226 provided with a single driving unit. In such a case, one of the driving units 252 is replaced by an upper roller identical with upper rollers 248 provided on the other support frame 224, as shown in FIG. 14. As indicated before, it is to be understood that the single driving unit 252 can be alternately mounted on the front main support frame 224. In still further alternate designs, both support frames 224 and 226 can be provided with one or two driving units 252, mounted in a same manner as indicated before.

Referring now to FIG. 18, there is shown straight guide rail portions 302 and 304 secured to an adjacent rock surface 1 of a mine cavity, which are connected to both ends of a curved guide rail portion 306, as indicated before with reference. In FIG. 18, the working platform 301 is in a transport mode with the stabilizing extension posts 48 being retracted, and the piston 117 being pivotally connected to the boom free end 100, in an extended position adapted to distance variation due to varying rail orientation. It can also be seen from FIG. 18 that a front structural member 305 which has a first end 309 connected to a pivot attachment 311 secured to a boom end support frame 307 of a similar construction than the main support frame 224, and a second end 313 connected to a pivot attachment 315 secured in front of the main frame 204. It can be seen that either the front structural member 305 and the main support frames 226 are angularly positioned about the main frame 34 for still better adaptation to varying rail orientation. As indicated before, the extension of the piston 117 is adjusted according to the orientation of the displaceable working platform 301 with reference to the guide rail 300, which orientation depends on the specific longitudinal profile of the guide rail 14.

Figure 17:
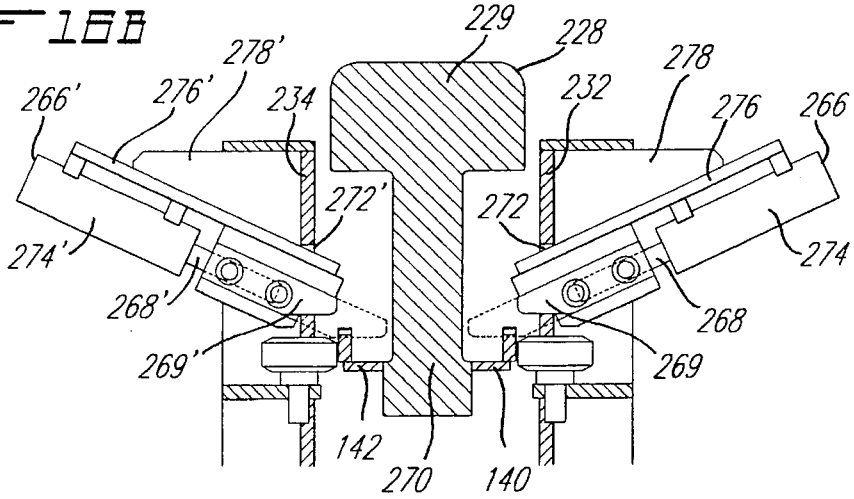
FIG. 17 is an alternate locking device that can be mounted on the support frame as provided on the apparatus according to the present invention.

Referring to FIGS. 15 and 17, a platform locking means which is preferably provided on each support frame 224 and 226 and connected to the control unit as indicated before, will be described. It is to be understood that such platform locking means can also be provided on the apparatus as shown in FIG. 1 to 7. This locking means is operated to immovably secure the working platform on the guide rail, prior operating the telescopic boom 60.

In a first example as shown in FIG. 15, the platform locking means comprises a pair of locking assemblies 258 and 258 provided on one or both of the main support frames 224 and 226 and having respective arresting posts 260 and 260. These posts have respective ends 262 and 262 for abutment on the respective upper parts of the first and second elongated guide members 140 and 142, causing the roller means to be lifted from the guide members 140 and 142 in a lock position, wherein the inner lower edges of the front and rear walls 238 and 240, as shown in FIG. 12, are in a rigid abutment on the lower surface of the rail 228. The rods 260 and 260 are housed in a telescopic manner in respective hydraulic cylindrical housings 264 and 264 mounted on the main support frames 224 and 226 to be extendible from the cylindrical housings 264 and 264. In a second example as shown in FIG. 17, the platform locking means comprises a pair of locking assemblies 266 and 266 provided on one or both of the main support frames 224 and 226 and having respective arresting posts 268 and 268. These posts have respective ends 269 and 269 for abutment on the respective sides of the rail core portion 270, causing the roller means to be lifted from the guide members 140 and 142 in a lock position. The rods 268 and 268 traverse respective bores 272 and 272 provided on the opposed side walls 232 and 234. The rods 268 and 268 are being housed in a telescopic manner in respective hydraulic cylindrical housings 274 and 274 mounted on the main support frames 224 and 226 on respective opposed side walls 232 and 234 through attachments 276 secured thereto by flanges 278 and 278, so as to be extendible from the cylindrical housings 274 and 274.

The basic operation of the working platform according to the present invention in a mine working application will be now described with reference to FIGS. 1 and 5. The displaceable working platform 32 can either be mounted on a previously installed rail, or be used for the assembly and installation of the rail. The working platform 32 can be initially brought on the site where a first rail section is installed, by any proper transport means, such as load elevator or winch apparatus. The working platform 32 can alternately be permanently installed on a rail portion installed within a storage site, such as a storage drift, and communicating through a rail switching mechanism to the first rail section. When used for the assembly and installation of the rail, the working platform 32 can be progressively displaced along a latest installed rail section. In some mine working operation such as in rock blasting, the rail has to be removed after use, and the displaceable working platform 32 is progressively withdrawn as the rail sections are successively removed from the mine area to be blasted.

At a desired working position along the rail, the control unit is operated to successively stop the driving units 33, engage the locking assemblies, and extend the telescopic extension posts 48 for rigid securing on the surrounding rock surface. The operator finally releases the boom end 100 from the boom end support frame 116, before operating the boom 60 as shown in FIG. 5. When the working platform 32 needs to be displaced again on the rail 12, the operator engages the boom end 100 with the boom end support frame 116, commands the control unit to withdrawn the telescopic extension posts 48 from the rock surface, and releases the locking assemblies before operating the driving units 33 in a desired direction.

We claim:

1. A displaceable working apparatus comprising:

a guide rail comprised of a plurality of connected guide rail sections suspended from a surface adjacent said guide rail;

a displaceable working platform comprised of a main frame secured to a main support means movably secured to said rail, main stabilizing means for immovably securing said main frame to said adjacent surface, an extensible boom pivotally secured to a rotating support base positioned under said main frame and secured thereto, said boom having a working free end adapted to secure a working element thereto, means to rotate said boom on said rotating support base, means to control the extension of said boom, means to regulate the angular position of said boom with respect to said rotating support base, and driving means mounted on said frame to displace said platform along said guide rail.

2. A displaceable working apparatus as claimed in claim 1 wherein said displaceable working apparatus is a mine working apparatus.

3. A displaceable mine working apparatus as claimed in claim 2, wherein said working element is a working end platform for supporting a load or a person thereon.

4. A displaceable mine working apparatus as claimed in claim 3, wherein said working end platform has a pair of lateral stabilizing means for immovably securing said working end platform to two opposed lateral surrounding surfaces of a mine cavity.

5. A displaceable mine working apparatus as claimed in claim 4, wherein said working end platform has a frame, each said lateral stabilizing means comprising a telescopic extension post secured to said frame and extending parallel to an horizontal plane thereof for engagement with said opposed lateral surrounding surfaces.

6. A displaceable mine working apparatus as claimed in claim 2, wherein said working platform has a tool secured to a support member secured on said working platform.

7. A displaceable mine working apparatus as claimed in claim 2, wherein said working element is a remotely operable tool secured to a support frame at said boom free end.

8. A displaceable mine working apparatus as claimed in claim 2, wherein said working element is a hook for carrying a load, said hook means being secured to a support member at said boom free end.

9. A displaceable mine working apparatus as claimed in claim 2, wherein said working element is a scraping element.

10. A displaceable mine working apparatus as claimed in claim 9, wherein said displaceable working platform further comprises a winch unit mounted on said rotating support base, said scraping element having a pulley means pivotally secured to a support member at said boom free end, a scraper means attached to a cable connected to said winch unit, said scraper means being be displaced along said boom upon operation of said winch unit for scraping a floor portion of a mine drift.

11. A displaceable mine working apparatus as claimed in claim 2, wherein said main stabilizing means comprises a plurality of upper telescopic extension posts secured to said main frame and extending for engagement with a ceiling portion of a mine cavity, said extension posts being independently adjusted to control the angular position of said main frame relative to said guide rail.

12. A displaceable mine working apparatus as claimed in claim 11, wherein said main frame has a substantially rectangular main portion, there being two pairs of upper telescopic extension posts secured on a respective side of said frame main portion, each said posts having an arresting rod at an upper end thereof.

13. A displaceable mine working apparatus as claimed in claim 12, wherein said arresting rod has pointed conical ends for engaging in a rock surface of said mine cavity ceiling portion, each said upper telescopic extension posts being housed in a telescopic manner in an hydraulic cylindrical housing secured to said main frame and being independently extendible from an upper end of said cylinder housing.

14. A displaceable mine working apparatus as claimed in claim 2, wherein said main stabilizing means comprises a plurality of upper telescopic extension posts secured to said main frame and extending for engagement with a ceiling portion of a mine cavity, and at least one lower telescopic extension post secured to said main frame and extending for engagement with a floor portion of said mine cavity, said extension posts being independently adjusted to control the position of said main frame relative to said guide rail.

15. A displaceable mine working apparatus as claimed in claim 14, wherein said main frame has a substantially rectangular main portion, there being four upper telescopic extension posts secured on a respective corner of said frame main portion, at least two lower telescopic extension posts secured to said respective corners, and a central lower telescopic extension post secured to said main frame, each said posts having an arresting rod at opposed ends thereof.

16. A displaceable mine working apparatus as claimed in claim 15, wherein said central lower telescopic extension post being housed in a telescopic manner in an hydraulic cylindrical housing pivotally secured to said main frame and being independently extendible from a lower end of said cylinder housing.

17. A displaceable mine working apparatus as claimed in claim 15, wherein said arresting rod has pointed conical ends for engaging in a rock surface of said mine cavity, each said telescopic extension posts being housed in a telescopic manner in an hydraulic cylindrical housing secured to said main frame and being independently extendible from a corresponding end of said cylinder housing.

18. A displaceable working apparatus as claimed in claim 1, wherein said working element is pivotally secured to said boom free end, said apparatus further comprising a means to regulate angular position of the working element with respect to said boom free end.

19. A displaceable working apparatus as claimed in claim 1, wherein said main support means comprises at least two main support frames provided with roller means, each of said support frames having first and second opposed side walls secured in space parallel relationship, said opposed side walls defining a channel traversed by said guide rail.

20. A displaceable working apparatus as claimed in claim 19, wherein each of said rail sections includes an elongate core portion secured at both ends thereof to a pair of junction means, and first and second elongated guide members extending in parallel relationship along respective sides of said core portion, upper and lower parts of said first guide member respectively defining first upper and lower tracks, upper and lower parts of said second guide member respectively defining second upper and lower tracks, said main support means being movably secured to said tracks.

21. A displaceable working apparatus as claimed in claim 20, wherein said displaceable working platform further comprises a platform locking means to immovably secure said working platform on said guide rail.

22. A displaceable working apparatus as claimed in claim 21, wherein said platform locking means comprises a pair of locking assemblies provided on one or more of said main support frames and having respective arresting posts, said posts having respective ends for abutment on the respective upper parts of said first and second elongated guide members causing said roller means to be lifted from said guide members in a lock position, said posts being housed in a telescopic manner in respective cylindrical housings mounted on said main support frames so as to be extensible from said cylindrical housings.

23. A displaceable working apparatus as claimed in claim 21, wherein said platform locking means comprises a pair of locking assemblies provided on one or more of said main support frames and having respective arresting posts, said posts having respective ends for abutment on the respective sides of said rail core portion, said arresting posts traversing respective bores provided on the opposed side walls of said main support frames and being housed in a telescopic manner in respective cylindrical housings mounted on main support frame on respective opposed side walls thereof so as to be extensible from said cylindrical housings.

24. A displaceable mine working apparatus as claimed in claim 19, wherein said main frame has a substantially rectangular main portion including first and second beams secured in spaced parallel relationship by first and second transverse structural members, there being first and second main support frames respectively secured on said first and second transverse structural members.

25. A displaceable mine working apparatus as claimed in claim 24, wherein said boom is laterally rotatable on said rotating support base over an arc of 360°, said boom being also angularly positionable up or down to an angle of about 45° below an horizontal axis of said rotating support base, said boom being further angularly positionable up or down to an angle of about 15° over an horizontal axis of said rotating support base whenever said boom is positioned transversely under any of said first and second structural members.

26. A displaceable mine working apparatus as claimed in claim 24, wherein each of said rail sections includes an elongate core portion secured at both ends thereof to a pair of junction means, and first and second elongated guide members extending in parallel relationship along respective sides of said core portion, upper and lower parts of said first guide member respectively first upper and lower tracks, upper and lower parts of said second guide member respectively defining second upper and lower tracks, said main support means being movably secured to said tracks.

27. A displaceable mine working apparatus as claimed in claim 26, wherein said roller means further includes a pair of lateral opposed rollers mounted on said first and second side walls and abutting on side portion of said first and second elongated guide members.

28. A displaceable mine working apparatus as claimed in claim 27, wherein the roller means provided on each said main support frames includes a pair of lower opposed rollers mounted on said first and second side walls and engaging said first and second lower tracks, the roller means provided on one of said main support frames further including a pair of upper opposed rollers mounted on said first and second side walls and engaging said first and second upper tracks, the other one of said main support frames further including an upper roller mounted on said first side wall and engaging said first upper track, said driving means including a driving unit mounted on the second side wall of the other one of said main support frames and having a driving shaft provided with a teethed end for engaging a rack bar comprised in said rail second guide member.

29. A displaceable mine working apparatus as claimed in claim 27, wherein the roller means provided on each of said main support frames includes a pair of lower opposed rollers mounted on said first and second side walls and respectively engaging said first and second lower tracks, an upper roller mounted on said first side wall and engaging said first upper track, said driving means including first and second driving units respectively mounted on the second side walls of said first and second main support frames and each having a driving shaft provided with a teethed end for engaging a rack bar comprised in said rail second guide member.

30. A displaceable mine working apparatus as claimed in claim 19, wherein said main frame has a substantially rectangular main portion including first and second beams secured in spaced parallel relationship by first and second transverse structural members pivotally secured thereto by means of first and second pivot means provided on said first and second transverse structural members, there being first and second main support frames secured on said first and second transverse structural members.

31. A displaceable mine working apparatus as claimed in claim 30, wherein said first and second structural members have respective opposed ends, each said pivot means comprises a pair of opposed pivot assemblies respectively disposed between one end of said corresponding transverse structural members and said corresponding main support frame and between the other end of said corresponding transverse structural member and said corresponding main support frame, each said first and second beams being connected to said corresponding pivot assemblies by means of a pair of mounting means having first end respectively secured to said first and second beams and second end respectively secured to said corresponding pivot assemblies.

32. A displaceable mine working apparatus as claimed in claim 31, wherein said main stabilizing means comprises two pairs of upper telescopic extension posts secured to respective ends of said first and second transverse structural members, said extension posts extending for engagement with a ceiling portion of a mine cavity, said extension posts being independently adjusted to control the angular position of said main frame relative to said guide rail.

33. A displaceable mine working apparatus as claimed in claim 32, wherein each said posts have an arresting rod at an upper end thereof having a pointed conical end for engaging in a rock surface of said mine cavity ceiling portion, each said telescopic extension posts being housed in a telescopic manner in an hydraulic cylindrical housing secured to said respective ends of the first and second transverse structural members and being independently extendible from an upper end of said cylinder housing.

34. A displaceable mine working apparatus as claimed in claim 31, wherein said main stabilizing means comprises four upper telescopic extension posts secured to respective ends of said first and second transverse structural members, said extension posts extending for engagement with a ceiling portion of a mine cavity, and at least one lower telescopic extension post secured to said main frame and extending for engagement with a floor portion of said mine cavity, said extension posts being independently adjusted to control the position of said main frame relative to said guide rail.

35. A displaceable mine working apparatus as claimed in claim 34, wherein there being at least one pair of lower telescopic extension posts secured to respective ends of any of said first and second transverse structural members, and a central lower telescopic extension post secured to said main frame, each said posts having an arresting rod at opposed ends thereof.

36. A displaceable mine working apparatus as claimed in claim 35, wherein said central lower telescopic extension post is housed in a telescopic manner in an hydraulic cylindrical housing pivotally secured to said main frame and being independently extendible from a lower end of said cylinder housing.

37. A displaceable mine working apparatus as claimed in claim 35, wherein said arresting rod has pointed conical ends for engaging in a rock surface of said mine cavity, each said upper and at least two lower telescopic extension posts being housed in a telescopic manner in an hydraulic cylindrical housing secured to respective ends of said first and second transverse structural members and being independently extendible from a corresponding end of said cylinder housing.

38. A displaceable mine working apparatus as claimed in claim 30, wherein each of said rail sections includes an elongate core portion secured at both ends thereof to a pair of junction means, and first and second elongated guide members extending in parallel relationship along respective sides of said core portion, upper and lower parts of said first guide member respectively defining first upper and lower tracks, upper and lower parts of said second guide member respectively defining second upper and lower tracks, said main support means being movably secured to said tracks.

39. A displaceable mine working apparatus as claimed in claim 38, wherein said roller means further includes lateral opposed rollers pairs mounted on said first and second side walls and abutting on a side portion of said first and second elongated guide members.

40. A displaceable mine working apparatus as claimed in claim 39, wherein the roller means provided on each said main support frames includes two parallel spaced pairs of lower opposed rollers mounted on said first and second side walls and engaging said first and second lower tracks, the roller means of one of said main support frames further including two pairs of parallel spaced upper opposed rollers mounted on said first and second side walls and engaging said first and second upper tracks, the roller means of the other one of said main support frames further including a pair of upper opposed rollers mounted on said first and second side walls and engaging said first and second upper tracks and an upper roller mounted on said first side wall and engaging said first upper track, said pair of opposed rollers and said upper roller being in parallel spaced relationship, said driving means including a driving unit mounted on the second side wall of the other one of said main support frames and having a driving shaft provided with a teethed end for engaging a rack bar comprised in said rail second guide member.

41. A displaceable mine working apparatus as claimed in claim 39, wherein the roller means provided on each said main support frames includes two parallel spaced pairs of lower opposed rollers mounted on said first and second side walls and engaging said first and second lower tracks, two pairs of upper opposed rollers mounted on said first and second side walls and engaging said first and second upper tracks, an upper roller mounted on the first side wall of said main support frames and engaging said first upper track, said pair of upper opposed rollers and said upper roller being spaced in a parallel relationship, said driving means including a driving unit mounted on each said main support frames and having a driving shaft provided with a teethed end for engaging a rack bar comprised in said rail second guide member.

42. A displaceable mine working apparatus as claimed in claim 39, wherein the roller means provided on each said main support frames includes two parallel spaced pairs of lower opposed rollers mounted on said first and second side walls and engaging said first and second lower tracks, the roller means of one of said main support frames further including two parallel spaced pairs of upper opposed rollers mounted on said first and second side walls and engaging said first and second upper tracks, the roller means of the other one of said main support frames further including two parallel spaced upper rollers mounted on said first side wall and engaging said first upper track, said driving means being comprised by a pair of parallel spaced driving units mounted on the second side wall of the other one of said main support frames and each having a driving shaft provided with a teethed end for engaging a rack bar comprised in said rail second guide member.

43. A displaceable mine working apparatus as claimed in claim 39, wherein the roller means provided on each said main support frames includes two parallel spaced pairs of lower opposed rollers mounted on said first and second side walls and engaging said first and second lower tracks, the roller means of one of said main support frames further including a pair of upper opposed rollers mounted on said first and second side walls and engaging said first and second upper tracks, the roller means of the other one of said main support frames further including two parallel spaced upper rollers mounted on said first side wall and engaging said first upper track, said driving means including a first driving unit mounted on the second side wall of said one of said main support frames and second and third parallel spaced driving units mounted on the second side wall of the other one of said main support frames, each said driving units having a driving shaft provided with a teethed end for engaging a rack bar comprised in said rail second guide member.

44. A displaceable mine working apparatus as claimed in claim 39, wherein the roller means provided on each said main support frames includes two parallel spaced pairs of lower opposed rollers mounted on said first and second side walls and engaging said first and second lower tracks, two parallel spaced upper rollers mounted on said first side wall and engaging said first upper track, said driving means including two pairs of parallel spaced driving units respectively mounted on the second wide walls of said main support frames and each having a driving shaft provided with a teethed end for engaging a rack bar comprised in said rail second guide member.

45. A displaceable working apparatus as claimed in claim 1, wherein said extensible boom is comprised of a plurality of straight boom sections disposed one within another, a first one of said boom sections being mounted at a rear end portion to a boom support frame pivotally secured to said rotating support base.

46. A displaceable working apparatus as claimed in claim 45, wherein said extensible boom is rotatable about a longitudinal axis thereof by means of an actuating means connected between said boom support frame and first boom section.

47. A displaceable working apparatus as claimed in claim 46, wherein said extensible boom is rotatable on said boom support frame over a range of about 70°

48. A displaceable working apparatus as claimed in claim 45, wherein said means to regulate the angular position of said boom comprises one or more pistons secured between said rotating support base and said boom support frame, said means to rotate said boom on said rotating support base being a reduction gearing motor.

49. A displaceable working apparatus as claimed in claim 45, wherein said means to control the extension of said boom comprises an hydraulic system connected to a telescopic hydraulic cylinder longitudinally housed in said boom and having opposed ends respectively coupled to said first boom section and said boom free end whereby each said boom sections is sequentially extensible from within another.

50. A displaceable working apparatus as claimed in claim 1, wherein said working platform further comprises a boom free end support means secured to a first end of a front structural member having a second end pivotally secured on said main frame, said boom free end support means being detachably secured to said boom free end and movably secured to said rail to support said boom free end when said working platform is displaced along said guide rail from a storage position to a working position.

51. A displaceable working apparatus as claimed in claim 50, wherein said displaceable working platform further comprises driving control means adapted to sense a securing condition of said boom free end on said boom free end support means, said driving control means enable an operator to command displacement of said platform along said guide rail only if a securing condition is sensed.

52. A displaceable working apparatus as claimed in claim 50, wherein said boom free end support means comprises a boom end support frame provided with roller means and having first and second opposed side walls secured in space parallel relationship, said opposed side walls defining a channel traversed by said guide rail, and an extendible connecting means detachably secured between said boom end support frame and said boom free end.

53. A displaceable working apparatus as claimed in claim 52, wherein said extendible connecting means comprises a piston housed in a telescopic manner in an hydraulic cylindrical housing, said piston being independently extendible from an upper end of said cylinder housing.

54. A displaceable working apparatus as claimed in claim 50, wherein each of said rail sections includes an elongate core secured at both ends thereof to a pair of junction means, and first and second elongated guide members extending in parallel relationship along respective sides of said core portion, upper and lower parts of said first guide member respectively defining respective first upper and lower tracks, upper and lower parts of said second guide member respectively defining second upper and lower tracks, said boom free end support means being movably secured to said tracks.

55. A displaceable working apparatus as claimed in claim 54, wherein said roller means provided on said boom end support frame includes a pair of lower opposed rollers mounted on said first and second side walls and engaging said first and second lower tracks, and a pair of upper opposed rollers mounted on said first and second side walls and engaging said first and second upper tracks.

56. A displaceable working apparatus as claimed in claim 54, wherein said boom free end support means is pivotally secured to the first end of said front structural member the roller means provided on said boom end support frame including two parallel spaced pairs of lower opposed rollers mounted on said first and second side walls and engaging said first and second lower tracks, and two pairs of parallel spaced upper opposed rollers mounted on said first and second side walls and engaging said first and second upper tracks.

* * * * *